US011982162B2

(12) United States Patent
Miranda Tienda et al.

(10) Patent No.: US 11,982,162 B2
(45) Date of Patent: May 14, 2024

(54) DOWNHOLE DEVICE FOR HYDROCARBON PRODUCING WELLS WITHOUT CONVENTIONAL TUBING

(71) Applicant: INSTITUTO MEXICANO DEL PETRÓLEO, Mexico City (MX)

(72) Inventors: Isaac Miranda Tienda, Mexico City (MX); Rogelio Aldana Camargo, Mexico City (MX); Israel Herrera Carranza, Mexico City (MX); Edwin Daniel San Vicente Aguillón, Mexico City (MX); Jorge Flores Castillo, Mexico City (MX); Juan Antonio Castro Rodarte, Mexico City (MX); Samuel Pérez Corona, Mexico City (MX); Julie Mariana Ruiz Ramírez, Mexico City (MX); Adriana de Jesús Rocha Del Ángel, Mexico City (MX)

(73) Assignee: INSTITUTO MEXICANO DEL PETROLEO, Mexico City (MX)

( * ) Notice: Subject to any disclaimer, the term of this patent is extended or adjusted under 35 U.S.C. 154(b) by 307 days.

(21) Appl. No.: 17/272,391

(22) PCT Filed: Aug. 29, 2019

(86) PCT No.: PCT/MX2019/050019
§ 371 (c)(1),
(2) Date: Mar. 1, 2021

(87) PCT Pub. No.: WO2020/046105
PCT Pub. Date: Mar. 5, 2020

(65) Prior Publication Data

US 2022/0120164 A1 Apr. 21, 2022

(30) Foreign Application Priority Data

Aug. 30, 2018 (MX) ..... MX/A/2018/010465

(51) Int. Cl.
*E21B 43/02* (2006.01)
*E21B 43/04* (2006.01)
(Continued)

(52) U.S. Cl.
CPC ..... *E21B 43/04* (2013.01); *E21B 43/02* (2013.01); *E21B 43/10* (2013.01); *E21B 43/121* (2013.01); *E21B 43/267* (2013.01); *E21B 43/35* (2020.05)

(58) Field of Classification Search
CPC ..... E21B 43/35; E21B 43/34; E21B 43/36; E21B 43/38; E21B 43/385; E21B 43/40; E21B 43/121; E21B 43/13; E21B 43/02
See application file for complete search history.

(56) References Cited

FOREIGN PATENT DOCUMENTS

| | | |
|---|---|---|
| CA | 2051368 | 3/1993 |
| CN | 104100239 B | 10/2014 |

(Continued)

*Primary Examiner* — Catherine Loikith
(74) *Attorney, Agent, or Firm* — FisherBroyles, LLP; Jason P. Mueller

(57) ABSTRACT

The present invention is related to a downhole device for hydrocarbon producing wells without conventional tubing (tubingless completion), which improves the hydrocarbon production (gas, oil and condensate), selectively controls produced solids (reservoir sand and hydraulic fracture proppant) and eliminates liquid loading. The device of the present invention is designed according to selected well and reservoir characteristics by an integral methodology which includes the stages: data collection and analysis of the well operating conditions, selection of candidate well, sampling and analysis of produced solids, simulation of production conditions, design and manufacture and installation.

5 Claims, 20 Drawing Sheets

(51) Int. Cl.

| | |
|---|---|
| ***E21B 43/10*** | (2006.01) |
| ***E21B 43/12*** | (2006.01) |
| ***E21B 43/267*** | (2006.01) |
| ***E21B 43/34*** | (2006.01) |

(56) References Cited

FOREIGN PATENT DOCUMENTS

| | | | |
|---|---|---|---|
| MX | 2011008907 | A | 2/2013 |
| WO | 2008/152357 | A1 | 12/2008 |

Detail a -a'

Detail b -b'

Phases by X-ray diffraction

SAMPLE: T-212 well

| Formula | Phase |
|---|---|
| $SiO_2$ | Quartz (silicon dioxide) |
| $Na(AlSi_3O_8)$ | Albite (sodium aluminosilicate) |
| $KAlSi_3O_8$ | Sanidine (Potasium silicoaluminate) |

FILE DATA

CALCULATION | MATCH AND GRAPH | PRODUCTIVITY | MPFV SELECTION

UNITS
- ○ S.I
- ● ENGLISH SYSTEM

SURVEY
- ● VERTICAL WELL
- ○ DEVIATED WELL

VISCOSITY MODELS (DEAD OIL)
- ● GENERAL (TWU-B&S)
- ○ ASTM METHOD
- ○ PURE COMPONENTS (B&S)

| | | |
|---|---|---|
| TUBING DEPTH: | 5905.44 | FT |
| O.D. TUBUING: | 2.441 | IN |
| OIL DENSITY: | 54.0001 | °API |
| GAS FLOW RATE: | 0.426087 | MMSCFPD |
| GAS-LIQUID RATIO GLR (CAL=0): | 0 | SCF/BBL |
| GAS SPECIFIC GRAVITY: | 0.657 | AIR=1 |
| PRESSURE WELLHEAD: | 1202 | PSI |
| TEMPERATURE WELLHEAD: | 107.6 | °F |
| BOTTOMHOLE TEMPERATURE: | 206.6 | °F |
| TOTAL LIQUID FLOW RATE: | 123.101 | STB/DAY |
| WATER-CUT (CALC=0): | 73.62 | % |
| OIL/CONDENSATE FLOW RATE: | 37.474 | STB/DAY |
| WATER SPECIFIC GRAVITY: | 1.02 | (H2O = 1) |

○ TUBING&CASING 4

| | DEPTH M | |
|---|---|---|
| 1 | | |
| 2 | | |

#CALCULATION STEPS 28

- ● MATCH FLOW PATTERN
- ● MATCH LIQUID LOADING

UPDATE

FLOW PATTERN MAPS
- ○ GOVIER-AZIZ-WALLIS
- ● PETALAS - AZIZ
- ○ ORKISZEWSKI - GA

PIPELINE PRESS 950 PSI

ROUGHNESS 0.0006 IN

FRICTION FACTOR 1

SOLVE (RUN) | GIROSCOPIC

CRITICAL GAS VELOCITY MODEL
- ● DESHENG (TURNER&HL)
- ○ SHU LUO (PELICULA REV.)
- ○ NOSSIER (REG.FLUJO&μ)

GAS COMPRESSIBILITY Z-FACTOR
- ● HALL & YARB (TUNING 2014)
- ○ LATEEF & MUH (EXPLICIT 2015)
- ☐ IMPURITIES CO2, H2S & N2

| | DEPTH (M) | PRESSURE (PSI) | TEMPERATURE (°C) | GAS VELOCITY (FT/S) | CRITICAL VELOCITY (FT/S) | CRITICAL GAS RATE (M |
|---|---|---|---|---|---|---|
| 1 | 0.00 | 1202.00 | 41.9000 | 1.9597 | 9.7097 | |
| 2 | 67.00 | 1219.72 | 44.1195 | 1.9101 | 9.5181 | |
| 3 | 133.00 | 1237.62 | 46.3551 | 1.9167 | 9.5527 | |
| 4 | 200.00 | 1256.23 | 48.6059 | 1.9152 | 9.5530 | |
| 5 | 267.00 | 1273.35 | 50.8712 | 1.9225 | 9.5790 | |
| 6 | 333.00 | 1291.03 | 53.1499 | 1.9284 | 9.5980 | |
| 7 | 400.00 | 1309.23 | 55.4413 | 1.9258 | 9.5864 | |
| 8 | 467.00 | 1327.64 | 57.7443 | 1.9293 | 9.5948 | |
| 9 | 533.00 | 1346.51 | 60.0628 | 1.9275 | 9.5848 | |
| 10 | 600.00 | 1365.64 | 62.4156 | 1.9046 | 9.5056 | |
| 11 | 667.00 | 1384.24 | 64.7868 | 1.9172 | 9.5403 | |
| 12 | 733.00 | 1403.59 | 67.1554 | 1.9634 | 9.6625 | |
| 13 | 800.00 | 1424.94 | 69.5000 | 2.0361 | 9.8141 | |
| 14 | 867.00 | 1449.23 | 71.8556 | 2.2240 | 10.0818 | |
| 15 | 933.00 | 1479.77 | 74.1942 | 2.4231 | 10.2452 | |
| 16 | 1000.00 | 1516.11 | 76.4000 | 2.4372 | 10.2161 | |
| 17 | 1067.00 | 1553.72 | 78.4124 | 2.4933 | 10.2127 | |
| 18 | 1133.00 | 1593.52 | 80.3132 | 2.5467 | 10.1991 | |
| 19 | 1200.00 | 1635.42 | 82.2000 | 2.3439 | 10.0213 | |
| 20 | 1267.00 | 1674.07 | 84.1466 | 2.1933 | 9.8618 | |
| 21 | 1333.00 | 1713.23 | 86.1166 | 2.1292 | 9.76689 | |

CHOKE MEASUREMENT

● CHOKE ON | ÍTICO | ☐ GILBERT MODIFIY MODEL

BEAN SIZE 12 1/64" | INLET PRESSURE 1202 PSI | THROAT PRESSURE 658.466 PSI | ACTUAL MASS RATE 0.723165 LB/S

CV DISCHARGE 0.570891 | OUTLET PRESSURE 951.808 PSI | CALCULATED MASS RATE 1.26677 LB/S

FIG. 17

DOWNHOLE DEVICE FOR HYDROCARBON PRODUCING WELLS WITHOUT CONVENTIONAL TUBING

TECHNICAL FIELD

The present invention is related to a downhole device for hydrocarbon producing wells without conventional tubing (tubingless completion), which improves the hydrocarbon production (gas, oil and condensate), selectively controls produced solids (reservoir sand and hydraulic fracture proppant) and eliminates liquid loading. The device of the present invention is designed according to selected well and reservoir characteristics by an integral methodology which includes the stages: data collection and analysis of the well operating conditions, selection of candidate well, sampling and analysis of produced solids, simulation of production conditions, design and manufacture and installation.

The device of the present invention optimizes the remaining reservoir energy, avoiding the premature use of other technologies to promote hydrocarbon production, such as gas lift and sucker rod pumping.

BACKGROUND

Production, control and handling of solids, during hydrocarbon production, represent a critical and important challenge for both efficient management of reservoirs and equipment and facilities maintenance to transporting, conditioning and processing of oil and gas.

In mature fields there are severe production problems due to both liquid loading and solids accumulation in the petroleum production system components:

- Liquid loading is caused by slippage of liquid phase along the walls of casing and its accumulation at the bottomhole.
- Abrasion and wear in pipes and surface equipment, such as pumps, compressors, valves, separators, etc., are caused by solids production due to the flow of solid particles which travel from downhole to separation and compression facilities.

Different downhole control techniques are used in daily operations of hydrocarbon producing wells to avoid or reduce solids production (reservoir sand and hydraulic fracture proppant). Some of these techniques are:

- Production rate control
- Selective and oriented perforations
- Slotted liners
- Screens
- Gravel packs
- Chemical consolidation
- Frac-pack treatment Production Rate Control:

It is a passive method. It consists of flow rate regulation in such a manner that solids production is reduced to an acceptable level. This technique is least common and the cheapest to carry out. However, the maximum rate required to eliminate production solids generally is less than flow potential, so can result in significant production losses and economic benefits.

Selective and Oriented Perforations:

It is a passive method. It consists of determining orientation, location and length of the optimum perforated interval, which allows solids production to decrease. This location is the one with more compressive strength (but also lower permeability), it can withstand high anticipated pressure drop to achieve the optimum well production. However, this solution cannot be the most suitable from the effectiveness point of view, as the zones with greater compressive strength, are not generally communicating with the well.

Slotted Liners:

Consist of steel-base pipes with slots along the body of the pipe. A main application is in reservoir producing a high viscosity oil in horizontal wells drilled through unconsolidated high permeability sands. Reliability decreases in heterogeneous formations. Main configurations may not include gravel packing. In general, using slotted liner without gravel packing does not represent a good technique of sand control due to plugging. Unless the formation is a well-sorted, clean sand with a large grain size, this type of completion may have an unacceptably short producing life before the slotted liner or screen plugs. The case of slotted liner with gravel packing result in a more effective method. There is also an expandable slotted liner configuration, which is applied to improve production well while reducing sand production at low cost. The main problem with these liners is the slot size after expansion.

Screens:

Consist of a main filter designed according to an expected particle size, wrapping around a slotted or perforated steel liner. They are installed with tubing or casing during well completion stage. With this technique, sand production control can be achieved in bottomhole but a rig is required to maintenance the screen, which implies high costs and long time without production, although they are not available for tubing diameters smaller than 4 in. The device is also known as stand-alone screen. Among reasons for the wide use are simplicity and low cost. They are installed in openhole sections without gravel packing and can have several configurations or screen types: wrapped wire, prepacking, premium, expandable, among others.

Gravel Packing:

Usually consists of a cylindrical metal screen installed in the pay zone in which annular between screen and casing (or the formation, if the well is not cased) is filled with gravel. The gravel is pumped as slurry where pressure during placement is kept below fracture pressure. The gravel acts as filter to allow the fluids flow but stop the solid particles movement. The gravel size is selected as large as possible to minimize fluid flow restrictions by the gravel and at the same time small enough to filter out mobile particles and also fill the perforations. Gravel packing is the most widely used method to complete a well having production and sand control problems, in which the gravel can be placed beyond the casing in order to re-stress and stabilize the formation.

Chemical Consolidation:

Chemical consolidation of sand grains seems to be very sophisticated, but quite effective method for sand control. The resin systems are the most used, among the consolidation methods. Sand control treatment execution is divided in few stages: reservoir cleaning and water removal, treatment pumping and overflushing excess materials. Alternative solution to resin system pumping is resin-coated sand, incorporated in gravel packing operations which melts and consolidates on high temperatures.

Frac-Pack Treatment:

It is designed to create a fracture which propagates throughout of the formation, beyond of damage radio caused by invasion of drilling and completion fluids. Frac-pack completions have less damage than those with gravel packing and also more lifetime. Gravel packing prevents sand production by means of particle trap and formation damage is increased with time, which can be reduced with acid injection. In contrast, since flow geometry into frac-pack provides a greater area, and therefore, less pressure gradient in the face of formation, damage increase in the frac-pack is not expected with time, reducing or eliminating the need for well intervention.

On the other hand, the state of the art reports a series of devices, whose are described in the following patents information: MX 325779 of Nov. 21, 2014, U.S. Pat. No. 5,893,414A of Apr. 13, 1999, US 2006/0027372 A1 of Feb. 9, 2006, and U.S. Pat. No. 6,059,040A of May 9, 2000. In these patents information, a series of tubular-shaped devices are designed to be placed inside the tubing of the hydrocarbon producing wells. Devices described in these patents information comprise several successive concentric sections. Each section is hermetically fixed to the tubing. In addition, they have a Venturi-type inlet nozzle which disperses the liquids to form a mixture of liquid and gas phases, and an outlet nozzle.

According to the patents information, these devices improve the well production conditions but do not present a quantitative value, nor do they mention the presence of flow conditioners that help to eliminate the intermittent flow (batching by contribution of the reservoir) or abrasive solids, either of the reservoir or the hydraulic fracture or both.

Moreover, all the devices of the aforementioned patents information share the same disadvantage: the lack of elements that lead reduction of the damage of the device and the petroleum production system due to plugging and/or abrasion caused by the solids flow coming from the reservoir or the hydraulic fracture or both.

Another disadvantage of the devices in the aforementioned patents is that they only have a Venturi-type geometry, in which the separation and atomization processes simultaneously occur. Those processes prevent the maximum release of dissolved gas to occur, so that the energy of dissolved gas does not make the most before atomization of liquid phase occurs.

Since the tool is manufactured with a series of successive concentric sections, the fit between them cause turbulent flow due to the variations of diameters, which promote both loss of energy and alteration of the flow conditions. This causes the formation of large drops (relative to the flow) which adhere to the walls of the tubing causing annular flow and slippage of liquid phase, which limits in obtaining a homogeneous mixture and, consequently, the performance of the tool.

Another limitation of U.S. Pat. No. 6,059,040A patent application is the geometric arrangement of horizontal openings, which promote gravitational fall of liquids that descend by the wall of tubing and go without control inside the throat of Venturi-type geometry, instead of being dosed, whereas that geometry can dissipate liquid portion in mist form, limiting the performance of the tool.

The pressure losses in device presented at US 2006/0027372 A1 patent application are very low, given Laval geometry, so that a 100% of dissolved gas expansion is not achieved, which cause the formation of Zhukowski pulses (Hammer fluid). This effect decreases the productive life of the well.

The device of the present invention technically exceeds to those referred in the state of the art, since none of them has a structure that conditions the flow, so reducing the turbulence generated by the inlet geometry of the device, which is needed, if pretending reduce the energy loss on it.

Thus, the device goal of the present invention is takes advantage the energy of expansion process of reservoir gas to change the intermittent flow pattern by dispersed flow pattern, which facilitates its travel to surface and provides an increase of the productive life of the wells.

A device additional goal of the present invention is optimizing the take advantage of reservoir remaining energy, avoiding the premature use of technologies other to promote the hydrocarbon production through of production artificial systems, such as gas lift or sucker rod pumping.

Further, the device of the present invention has capacity of reduce up to 70% pressure requirement for transporting free of heavy particles liquids, from bottomhole to surface and increasing hydrocarbon production up to 300%.

This and other goals of device of the present invention are approached later with greater explicitness and detail.

BRIEF DESCRIPTION OF THE DRAWINGS

FIG. 17, shows the input information required by the "IMP Flow" simulator to reproduce the production conditions of the T-212 well.

DETAILED DESCRIPTION

The present invention is related to a downhole device for hydrocarbon producing wells without conventional tubing (tubingless completion), which improves the hydrocarbon production (gas, oil and condensate), selectively controls produced solids (reservoir sand and hydraulic fracture proppant) and eliminates liquid loading. The device of the present invention is designed according to selected well and reservoir characteristics by an integral methodology which includes the stages: data collection and analysis of the well operating conditions, selection of candidate well, sampling and analysis of produced solids, simulation of production conditions, design and manufacture and installation.

In the oil industry the term, tubingless completion is referred to a production casing used as production string to produce hydrocarbon without conventional tubing.

Figure 1:
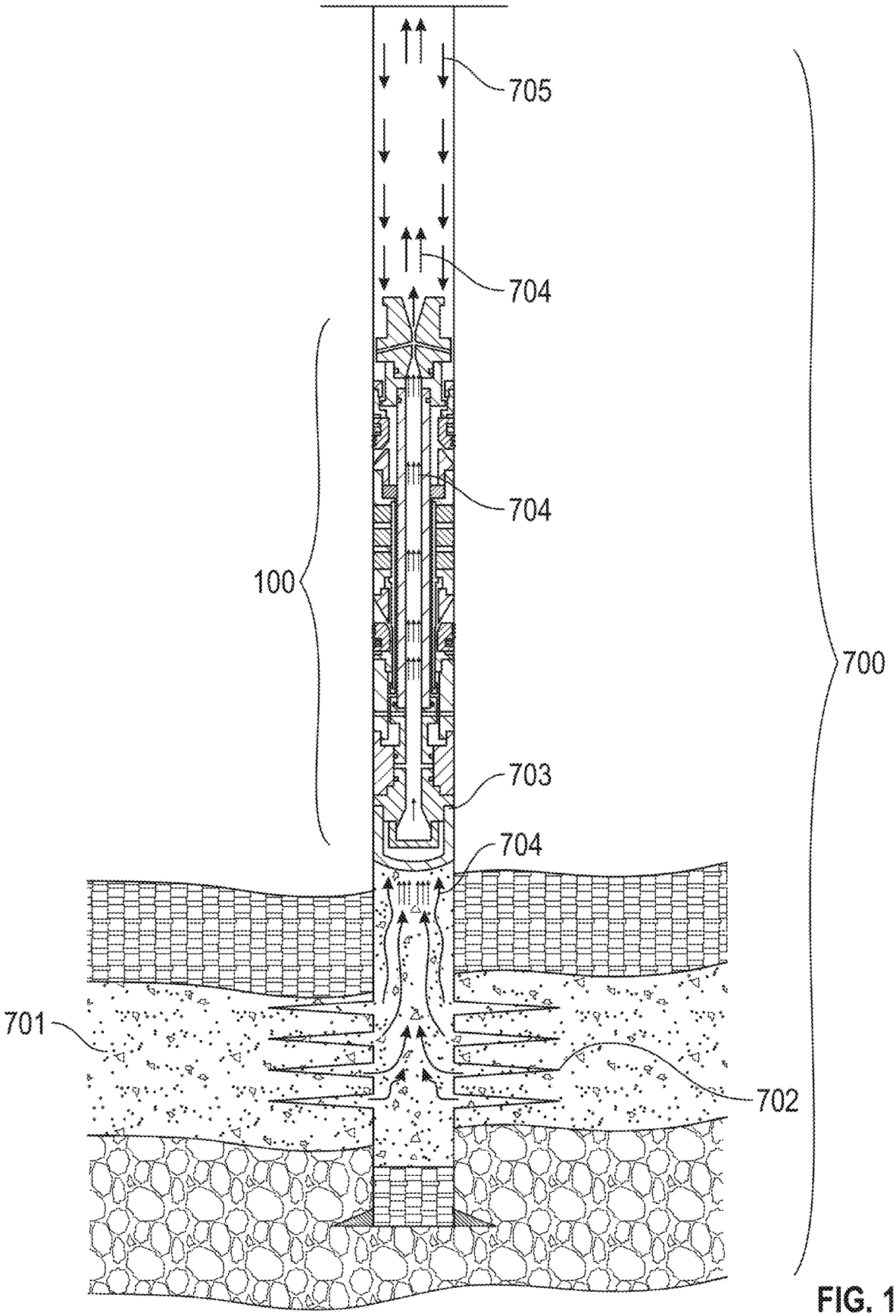
FIG. 1, shows the interior of a well without conventional tubing (tubingless completion) (700 section) and the downhole device for hydrocarbon producing wells without conventional tubing (tubingless completion) (100 section) of the present invention, as well as the hydrocarbon production flow (704) from reservoir to surface.

The downhole device for hydrocarbon producing wells with tubingless completion of the present invention is installed in production casing, as shown in FIGS. 1 (100 and 700 sections).

Figure 2:
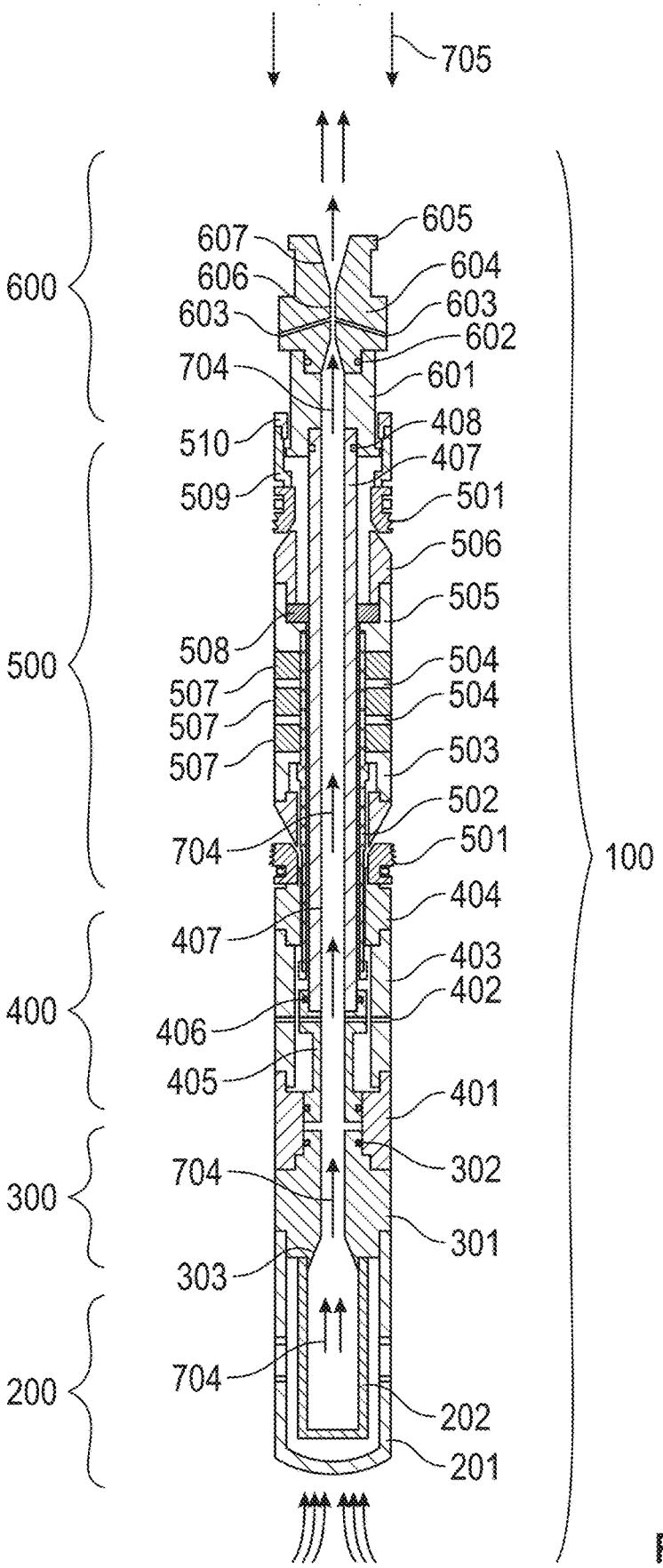
FIG. 2, shows the downhole device for hydrocarbon producing wells without conventional tubing (tubingless completion) (100 section), of the present invention, as well as the five different principal mechanical sections (first section (200 section), second section (300 section), third section (400 section), fourth section (500 section), and fifth section (600 section)).

In the present invention, the selective control of the produced solids (reservoir sand and hydraulic fracture proppant) is carried out by the filtering element (200 section) shown in FIG. 2, which device is equipped with. The opening size of filtering element with annular ovoid sintering (202) is selected according to the results of the analysis of the solid samples and the operating conditions of the well.

On the other hand, slippage of liquid phase is a phenomenon that occurs when the gas and liquid phases move upward inside the pipe at different speeds to the surface. A fraction of liquid (705), travels downward along the wall of the pipe towards the suction veins (603), where it is atomized when passing through the device of the present invention, to be displaced by the gas phase at the same speed, preventing the liquid phase from accumulating in the bottom of the well due to the effect of gravity and density differences.

The device of the present invention, shown in FIG. 1 (100), is installed in hydrocarbon producing wells with tubingless completion, shown in FIG. 1 (700), through an operation with slick line unit, or any other operational method. The objective is to eliminate the problems of liquid loading and at the same time to avoid the accumulation of solids in the components of the petroleum production system.

The device of the present invention; shown in FIG. 2 (100), is formed by mechanical elements, which retains produced solids, atomizes accumulated bottomhole liquids, facilitates its transport upward the surface; decreases the pressure loss and improves the flow pattern present in the pipe.

Figure 4:
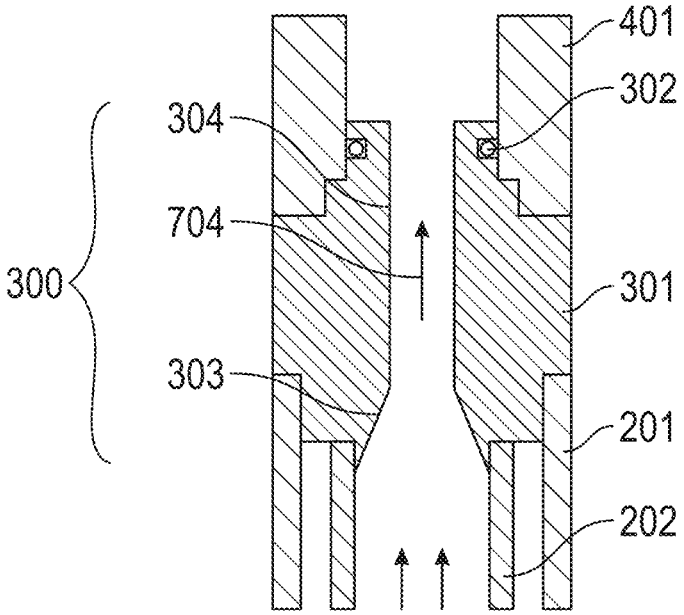
FIG. 4 shows the second section (300 section) primary flow conditioner of the downhole device for hydrocarbon producing wells without conventional tubing (tubingless completion) of the present invention.
Figure 5:
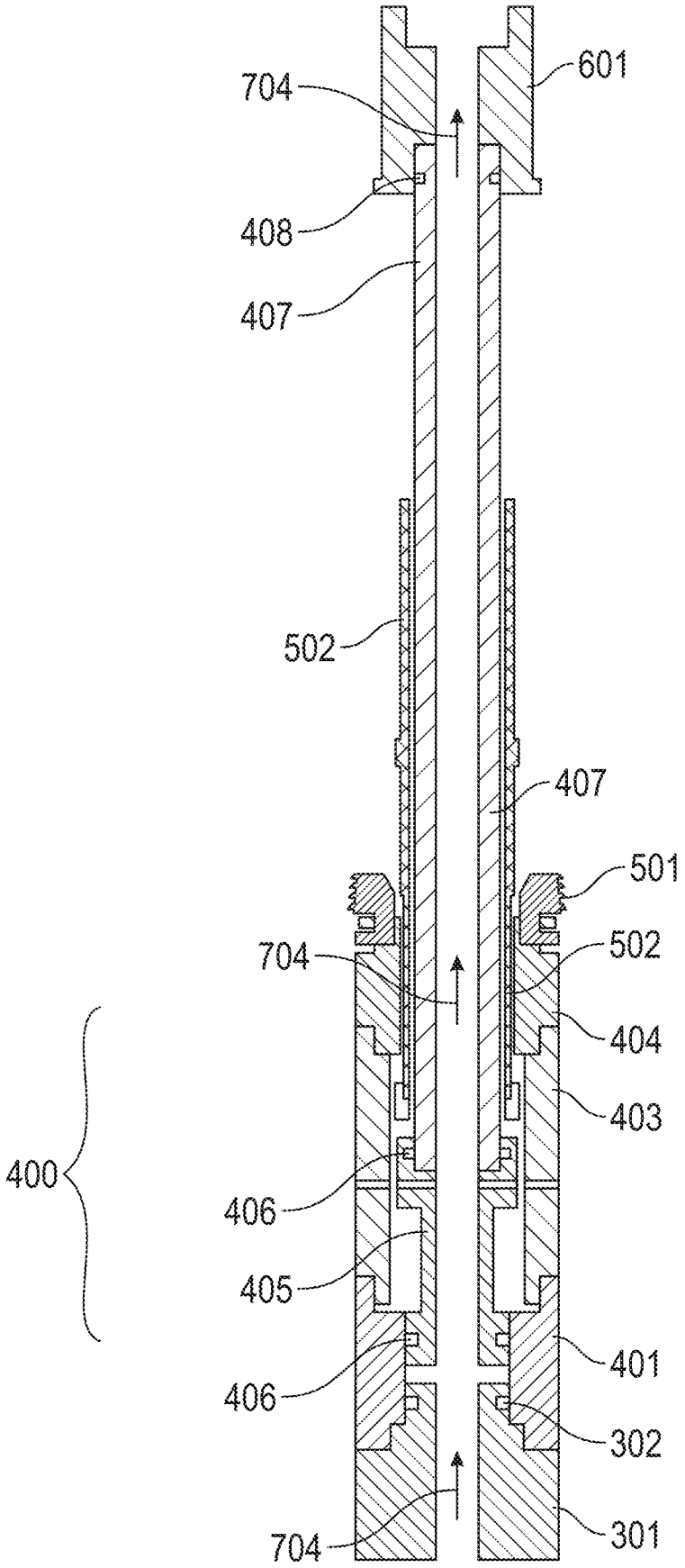
FIG. 5 shows the third section (400 section) homogenization and stabilization system of the downhole device for hydrocarbon producing wells without conventional tubing, where the turbulence and the liquid load inside the well are dissipated. The section is constituted by an area of flow and length, which are calculated according to the analysis of the production conditions of the well.
Figure 6:
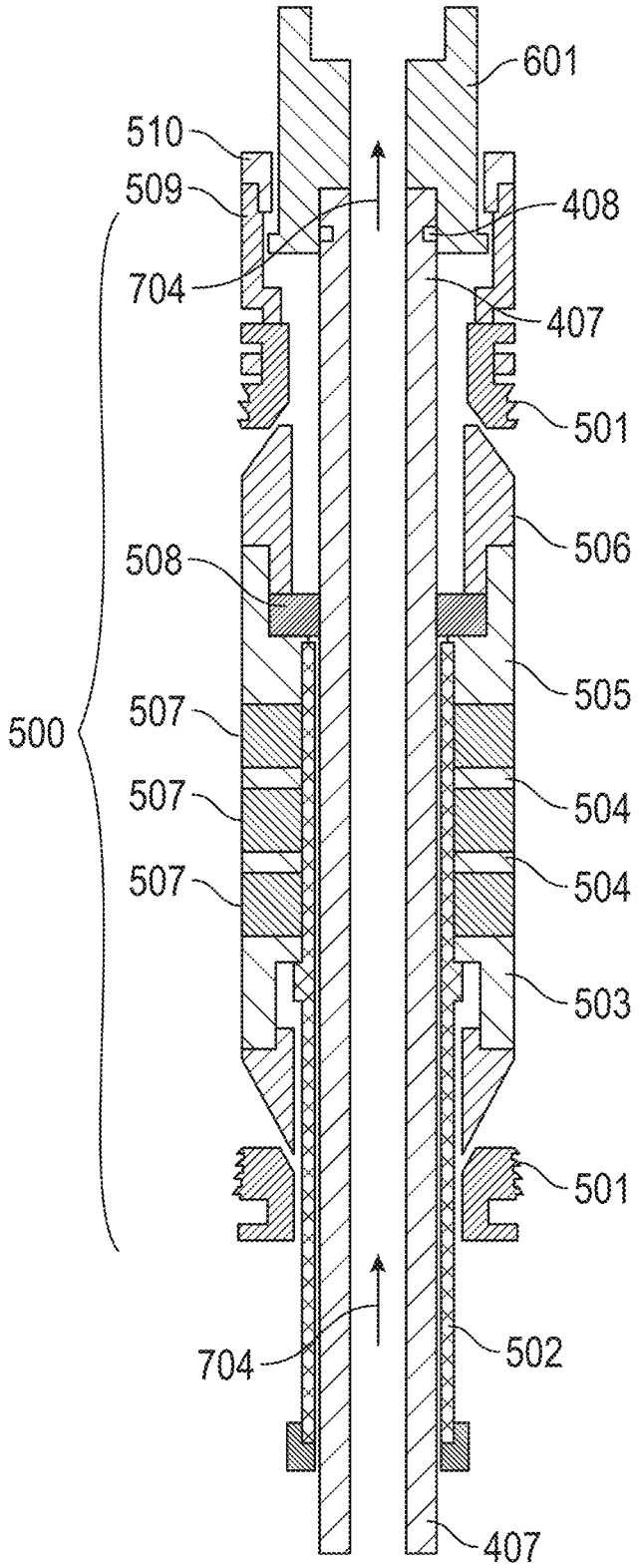
FIG. 6 shows the fourth section (500 section) anchoring and sealing system of the downhole device for hydrocarbon producing wells without conventional tubing, which allows fixing and sealing the downhole device for hydrocarbon producing wells without conventional tubing (tubingless completion) of the present invention.

The device of the present invention (section 100), consists of five principal mechanical sections:

First section (200), FIGS. 2, 3, 3*a* and 3*b*, refers to the filtering element with annular ovoid sintering (202) and protective housing (201), which retains the produced solids and forms a porous and permeable media outside that causes pressure losses through the filtering element with annular ovoid sintering (202) and the porous media, protecting all the components of the petroleum production system from abrasion;

Second section (300), FIGS. 2 and 4, refers to the primary flow conditioner (301), where the first pressure drop is carried out, due to flow area (303) decrease, so expanding the free gas and releasing the oil-dissolved gas of the hydrocarbon production flow;

Third section (400), FIGS. 2 and 5, refers to the homogenization and stabilization chamber (407), which leads the inside fluids to have a linear flow path;

Fourth section (500 section), FIGS. 2 and 6, refers to anchoring and sealing system (anchors 501 and flexible coaxial annular joints 507), which fixes the device in the pipe at any depth, according to the mechanical characteristics and requirements of the well, and seals the annular between casing and device; and Fifth section (600), FIGS. 2, 7, 7*a* and 7*b*, refers to the secondary flow conditioner (604), has fishing neck (605) which allows to install or recover the device of the present invention (100). The suction veins (603) are channels that communicate the low pressure zones inside the secondary flow conditioner with the liquids accumulated in the well. The liquid accumulated outside the system is suctioned inside the secondary flow conditioner due to high gas stream velocity (impeller fluid), which atomizes the drained liquids in the production casing forming a dispersed flow pattern and reduces the pressure requirement to transport fluids from the bottom to the surface. An O-ring (602) seals the contact between the secondary flow conditioner (604) and a support (601).

FIG. 1, shows the interior of a well without conventional tubing (tubingless completion) (700 section) and the downhole device for hydrocarbon producing wells without conventional tubing (tubingless completion) (100 section) of the present invention, as well as the hydrocarbon production flow (704) from reservoir to surface, reservoir (701), perforated interval (702), outside device (703) and slippage of liquid phase (705).

Fluids and produced solids flow begins in the reservoir (701), to continue, in case of exist, in hydraulic fracture, later crossing the perforated interval (702), until solids get accumulated the outside device of the present invention (703).

FIG. 2 (100) shows the downhole device for hydrocarbon producing wells with tubingless completion of the present invention, as well as the following five principal mechanical sections:

First section (200), filtering element;

Second section (300), primary flow conditioner;

Third section (400), homogenization and stabilization chamber;

Fourth section (500), anchoring and sealing system, and

Fifth section (600), secondary flow conditioner.

Figure 3:
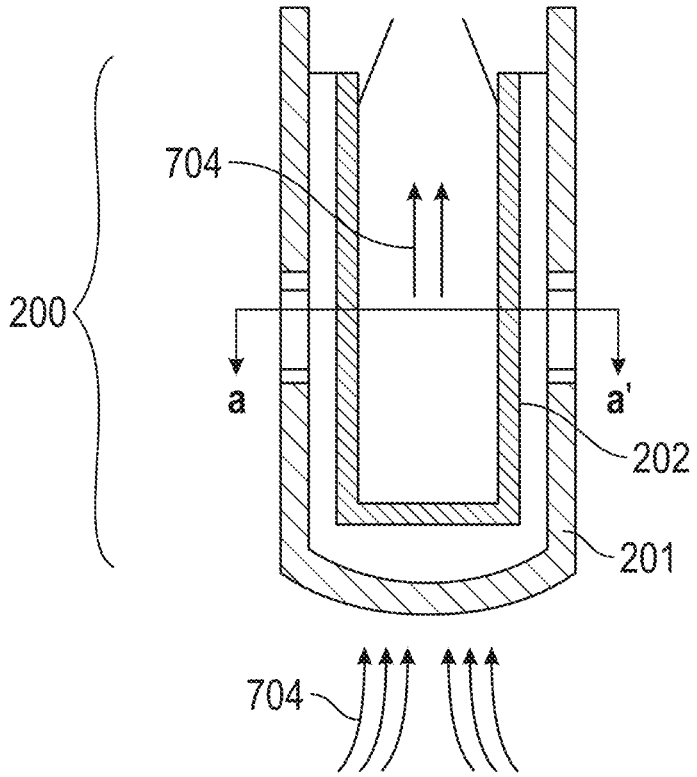
FIG. 3 shows the first section (200 section) filtering element of the downhole device for hydrocarbon producing wells without conventional tubing, including a protective housing (201) and a filtering element with annular ovoid sintering (202), which retains produced solids (reservoir sand and hydraulic fracture proppant) and avoids their transport with produced fluids in the well.
Figure 3A:
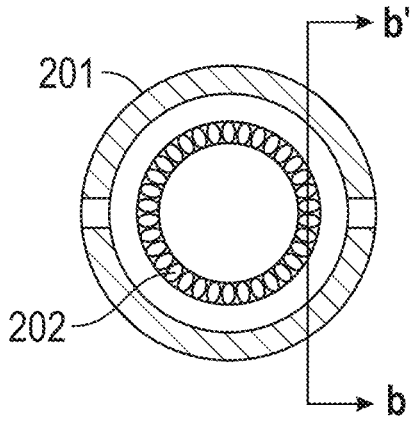
FIG. 3*a*, shows a cross section of the first section (200 section) filtering element (detail a-a' in FIG. 3), which is composed of a protective housing (201) and a filtering element with annular ovoid sintering (202), which retains passage of solids.

The following is a description of each section:

The first section (200), FIG. 3, shows the filtering element with annular ovoid sintering (202), which retains produced solids (reservoir sand and hydraulic fracture proppant), to prevent them from being transported from the bottomhole to the surface; likewise, on the outside protective housing (201), an additional layer of porous and permeable material is formed from the reservoir that works as an external filtering element, extending life time of the core of the filtering element with annular ovoid sintering (202). Both the core of the filtering element with annular ovoid sintering (202) and the outside protective housing (201) layer of accumulated solids (debris), protect all the components of the petroleum production system from abrasion, FIG. 3*a* shows the detail of the cross section a-a', composed of a filtering element with annular ovoid sintering (202), whose function is the selective control of produced solids in downhole device. FIG. 3*a* also shows the protective housing (201).

Figure 3B:
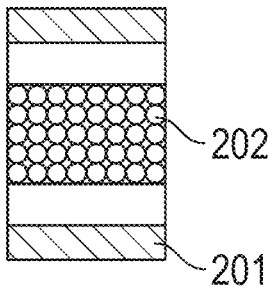
FIG. 3*b*, shows a longitudinal section of the first section (200 section) filtering element (detail b-b' in FIG. 3*a*), which is composed of a filtering element with annular ovoid sintering (202) and the protective housing (201), which receives collision of solid particles for decrease their abrasive effects, while that forming an solids layer (debris) which protects of abrasion all components of petroleum production system.

FIG. 3*b* shows longitudinal section of the filtering element (b-b' detail of FIG. 3*a*), having the protective casing (201), which receives the impact of solid particles and forms a layer of solids (debris), that serves as protection to filtering element with annular ovoid sintering (202) and other components of the petroleum production system against abrasion.

Second section (300 section), primary flow conditioner FIG. 4, is connected to the upper part of the filtering, element (200 section), by means of a preferably threaded connection, in which the fluids of the hydrocarbon production flow (704) enter, to a progressively decreasing cross section (303), until reach the circular flow area called throat (304), which extends as a cylindrical portion, up to a certain calculated length to maintain the bottomhole pressure at a sufficient level to transport the fluids to the surface, overcoming the pressure loss generated by fluid flow in the pipe, and is connected to the lower part of the homogenization and stabilization chamber (400 section), by an external sleeve (401).

Third section (400 section), FIG. 5, shows the homogenization and stabilization chamber (407), where the external sleeves (401, 403 and 404) that protect the homogenization and stabilization chamber (407) and its support (405) can be observed. This support is connected to the external sleeve (401) and to the homogenization and stabilization chamber (407). The homogenization and stabilization chamber (407) has a calculated flow area and length by a methodology that defines design parameters of the device and compares them with production conditions of the well, to dissipate turbulence and slippage of liquid phase, generated by section changes. The homogenization and stabilization chamber (407) is connected in lower part (401) with the primary flow conditioner (300), and in upper part (408) with the secondary flow conditioner (604), and outside supports the anchoring and sealing system (500) and the protective external sleeves (401, 403 and 404) of the homogenization and stabilization chamber (407).

The fourth section (500), FIG. 6, shows the anchoring and sealing system, which allows the device of the present invention to be installed in the production casing with tubingless completion above the perforated interval (702).

The anchoring and sealing system (500 section) consists of a tubular cylindrical portion (502) which has an outside with accessories that secure the elements that are part of the anchoring and sealing system (500 section), and in whose interior comes the flow of the well. Outside is provided with a set of elements fixed to a part of the well pipe, which are called anchors (501) and they are spaced from each other in a radial direction whose outside is provided with a clamp or parallel set of stepped rows, with a calculated surface hardness to partially penetrate the interior of the pipe: the anchoring and sealing system (500 section) is also provided with a series of flexible coaxial annular joints (507) spaced longitudinally to each other with spacer rings (504) and anchors (501) placed on external face, internally supported by a cylindrical portion (502), and externally supported by protective sleeves (503, 505 and 506); a bushing (508) restricts the core stroke and a second bushing (509) that supports the anchors is held in place by the supporting element (510).

Figure 7:
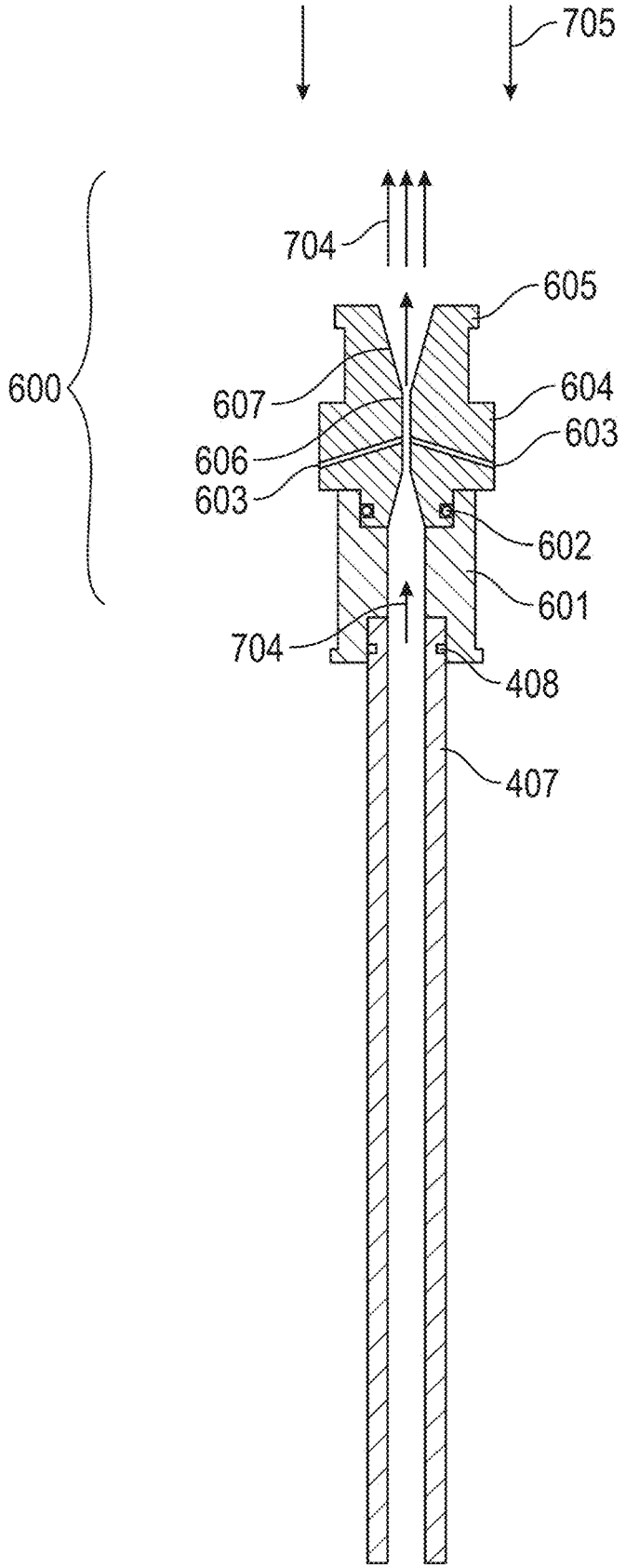
FIG. 7 shows the fifth section (600 section) secondary flow conditioner system of the downhole device for hydrocarbon producing wells without conventional tubing with suction veins (603). It is formed by a central passage opening, its geometry has a cross-section that decreases progressively at constant acute angle with respect to the symmetry axis, until reaching a circular flow area in a cylindrical portion called throat (606). The circular flow area and length of throat are calculated from data collection and analysis of the well operating conditions.
Figure 7A:
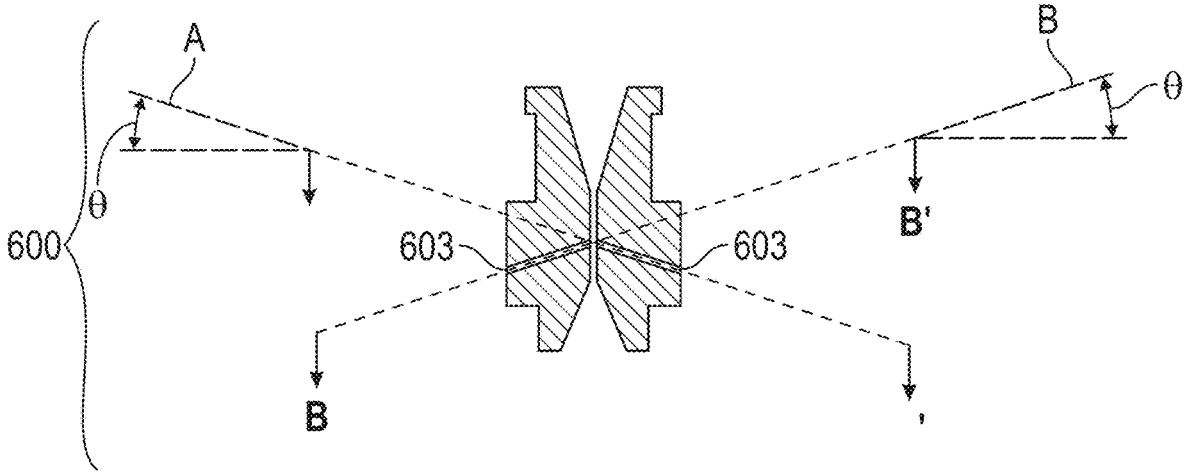
FIG. 7*a*, visualizes the angle of entry (o) of the liquids inside the fifth section (600 section) secondary flow conditioner system, through the suction veins (603), with a section designed for the restriction to the flow according to the well to be treated and is calculated from data collection and analysis of the well operating conditions.
Figure 7B:
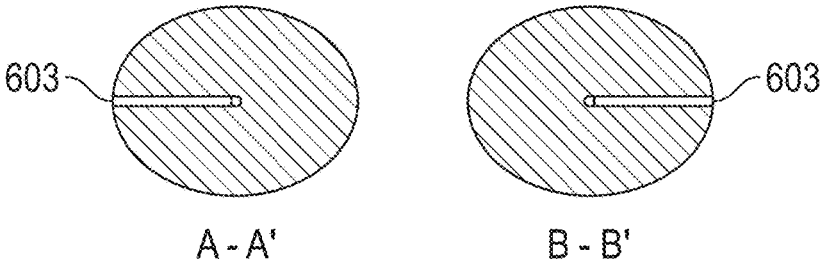
FIG. 7*b*, shows a cross-section of the two suction veins (603), where drained liquids enter, to the fifth section (600 section) secondary flow conditioner system.

Fifth section (600 section) FIG. 7, shows the secondary flow conditioner, has a central passage opening with a cross section that decreases at constant acute angle with respect to the axis of symmetry, until reach a circular flow area which extends as a cylindrical portion called throat (606). The circular flow area and the length of the throat are calculated according to the data collection and analysis of the production conditions of the well. The throat (606) has diagonally oriented openings called suction veins (603), which point towards the bottomhole to create a passage to the higher velocity zone of the secondary flow conditioner and to atomize the accumulated liquid to the outside of the system. Subsequently, the cross-sectional growth at constant acute angle calculated with respect to the axis of symmetry is presented. The secondary flow conditioner is connected to a support (601) with the homogenization and stabilization chamber (417) by means of a connection (408), preferably threaded and, in the upper part, it allows the hydrocarbon production flow (704) to exit in accelerated form through the central passage. Outside it has a fishing neck (605), to recover the device, when necessary.

In the hydrocarbon production flow (704) direction, the filtering element (200 section) is the first mechanical section, it is connected to primary flow conditioner (300 section) by a preferably threated connection (FIGS. 3 and 4) and it has the function of retain the produced solids (reservoir sand and hydraulic fracture proppant), to avoid the transport to surface, forming a natural porous and permeable media from the perforated interval (702) to outside of filtering element with annular ovoid sintering (202) which causes pressure drops through exterior filtering element, protecting all the petroleum production system components from abrasion, in addition of improving the well production conditions.

The primary flow conditioner is the second mechanical section and causes pressure drops through a flow restriction (303), generating gas expansion coming from the well at the outlet of this section (304). Sudden gas expansion increases flow velocity and promotes the formation of a homogeneous mixture in presence of liquid. The primary flow conditioner is connected at the homogenization and stabilization chamber (407) by a preferably threated connection (302).

Homogenization and stabilization chamber (400). It is the third mechanical section. It is connected in the lower end by a preferably threaded connection (408) to the primary flow conditioner and at the upper end to the secondary flow conditioner (600 section). It has the capacity of mixing the reservoir fluids with those accumulated at the bottomhole. Inside the homogenization and stabilization chamber takes place the homogenization and stabilization of gas and liquid coming from the second section (300) to then be transported to the secondary flow conditioner (600 section); a cavity (402) houses a mechanical pin to release the anchor.

Anchoring and sealing system (500 section). It is the fourth mechanical section. This system allows the device of the present invention to be installed in the well and transport the fluid inside of all the previously mentioned elements. It has mechanical anchors (501), which allow fixing the device of the present invention at the well pipe, and elastomer seals which seal outside of the device, in order to totally lead the flow inside of the device, as mentioned above.

Secondary flow conditioner (600 section). It is the fifth mechanical section. It is coupled to the homogenization and stabilization chamber (407) and it has the function of causing a second flow restriction. It has a geometry that increases the gas velocity forming internal zones of low pressure, where suction veins (603) are connected. Suction veins (603) are channels that communicate low pressure zones of the secondary flow conditioner interior with accumulated liquids in the well. Outside accumulated liquid of the system is suctioned due to high gas stream velocity (impeller fluid) reached at the secondary flow conditioner interior which atomizes the drained liquid in the production casing. It has a fishing-neck (605) in the upper end which allows the installation and retrieval of the device.

The device of the present invention is installed at the lower end of the production casing. It has the following functions: to retain the reservoir solids and the proppant of hydraulic fracture at the bottomhole forming a porous and permeable natural media; to increase the fluid velocity when passing through the first (200 section) and fifth (600 section) mechanical section; to expand the gas flowing together with hydrocarbon and water, free of solids, up to the surface, so allowing to obtain a uniform mixture (atomization of liquids in gas) to avoid flow intermittency problems and slippage of liquid phase. In addition, a back pressure is held on the face of the formation and frictional pressure losses through the well pipe are reduced.

The device of the present invention can be placed at the depth in which the bubbling pressure is presented. The above is very useful when handling high solution gas-oil ratios. In this case, additional released gas helps to "drag" accumulated liquids from the bottomhole to the surface without the need of an external power source.

The device of the present invention uses the energy of dissolved gas which, when released and expanded, allows accumulated fluids to be lifted from bottomhole to the surface. If the gas velocity is lower than the minimum drag velocity, slippage of liquid phase to the bottomhole through the walls of production casing will produce. Drained liquids are incorporated to secondary flow conditioner (604) via suction veins (603) due to high gas stream velocity within it (604), that is, low pressure zones distribute and atomize the liquids in the gas stream.

Based on the above, can be established that the device of the present invention increases gas velocity by promoting atomization of liquids. Upon reaching a gas velocity higher than 6 m/s, mist flow and continuous flow structure are achieved (in continuous gas phase there are scattered drops of liquid). Gas flow rate is high enough to avoid slippage of liquid phase and so be able to transport it up to surface. If liquid droplets flow in the same direction and velocity as gas, a mist flow structure is formed.

With the device of the present invention, abrasion problem caused by produced solids flow (sand reservoir and hydraulic fracture proppant) through the components of the petroleum production system is solved, and liquid accumulation in bottomhole is avoided. Likewise, it takes advantage of same energy of produced gas to "drag" accumulated liquid in bottomhole, in such a way that they are continuously produced, avoiding intermittent production or ultimate close of the wells. In other words, the device extends the flowing well life and allows to obtain greater energy resources by increasing the recovery factor.

The downhole device for hydrocarbon producing wells without conventional tubing of the present invention, which improves hydrocarbon production, selectively controls produced solids and eliminates liquid loading, mainly provides the following associated benefits:

- Retains produced solids from 50 microns size, which prevents abrasion caused by fluid flow at high velocity through the petroleum production system, additionally to production loss due to bottomhole fluid accumulation;
- Increases hydrocarbon production up to 300% by managing reservoir pressure and reducing the required pressure up to 70%;
- Optimizes the flow pattern by increasing gas velocity at least to 6 m/s which promotes that gas-liquid phase flows at the same velocity through the production casing;
- Reduces flowing pressure gradient in production casing due to gas expansion which flows with hydrocarbon and water, generating thus a uniform atomized mixture with minor density;
- Increases gas production whereas well production presents continuous and stable behavior, even during liquid discharge;
- Notably improves the flow pattern into production casing due to homogeneous dispersion formation of both phases generation;
- Decreases frictional pressure losses along production casing since avoids liquid accumulation at bottomhole;

Manages reservoir energy increasing flowing bottomhole pressure. This way, the percent of produced water due to coning is reduced up to 60%;

Holds stable behavior liquid production since improves the fluid flow pattern along production casing; and Extends the flowing well life since holds the reservoir energy because of pressure reduction along production casing.

The integral methodology used to obtain the downhole device for hydrocarbon producing wells without conventional tubing (tubingless completion) of the present invention, which improves hydrocarbon production, selectively controls produced solids (reservoir sand and hydraulic fracture proppant) and eliminates liquid loading is presented by a procedure, which includes the following stages:

I. Data collection and analysis of the well operating conditions. It consists of collecting all the information available from the well with solids production and/or liquids loading problems, such as: well schematic, production data, flowing bottomhole pressure log (until average perforations depth), gas chromatography, produced solids samples analysis, oil and water analysis, among others, in order to analyze and set the current well condition;

II. Selection of candidate well. It consists of data collected analysis in Stage I from hydrocarbon producing wells with solids production and liquid loading problems and comparison of main operational parameters obtained from analysis such as: gas/liquid ratio, gas and liquid densities, pressure and temperature profiles with flowing bottomhole, among others, against the determined value of these parameters, which the device will present an adequate functioning with. These values were obtained upon based of field results and extrapolated for limit conditions.

III. Sampling and analysis of produced solids. In this stage, the produced solids by the well are sampled, and the particles size distribution, composition and solubility analyses are carried out;

IV. Simulation of production conditions. In this stage, well production conditions are simulated to propose the optimal device design (filter and adequate diameter) as well as the optimal setting depth of the device of the present invention;

V. Design and manufacture. In this stage, design activities sequence based on a production forecast and well mechanic characteristics is carried out. The retainer device is manufactured based on specific characteristics of solids geometry and composition, to retain the major volume of particles, minimizing the pressure drops in the well.

VI. Installation. It consists of installing the device, preferably with slickline unit or any other operational method, inside the well at the depth obtained in simulation of production conditions stage, and then evaluating the benefits by a well behavior analysis.

The produced solids selective control (reservoir sand and hydraulic fracture proppant) is carried out by the filtering element the device is equipped with. The filtering element opening size with annular ovoid sintering is selected according to the results of the analysis of the solid samples and the operating conditions of the well.

The petroleum production system is eroded by solids coming from reservoir or hydraulic fracture proppant, so the particle size distribution, roundness and sphericity should be determined, in order to calculate the maximum permissible erosion rate. The device of the present invention avoids dragged solids during the hydrocarbon production exceed the maximum permissible erosion rate. On the other hand, the composition and solubility of produced solids should be determined to propose methods of cleaning and removing the retained particles by the device, without damaging the well or the reservoir. The methods of the cleaning and removing can be carried out with the device placed inside the well.

To determine if a well is candidate for installing the device of the present invention, the following information should be collected and analyzed to study the current and future behavior:

Well schematic. The maximum outer diameter of the device of the present invention and the optimal setting depth will be determined from the analysis of the information in well schematic. It must contain at least the following information: completion type; inner diameter, outer diameter, grade, weight and drift of casings; measured depth (MD); true vertical depth (TVD); deviation and azimuth of the well; and perforated interval.

Deviation survey. The analysis of information contained in the deviation survey allows to know maximum inclination angle, deviation severity, true vertical depth and measured depth, well type (vertical, deviated, horizontal) and technical feasibility for installing the device of the present invention.

Static bottomhole pressure log. It allows estimate the reservoir pressure value.

Flowing bottomhole pressure log by stations. Analyzing this log, holdup severity, flow pattern and dynamic pressure gradient at constant rate are determined and, together with production flow rate and static bottom hole pressure, the inflow behavior is calculated.

It is used to determine the daily production behavior of oil, gas, water and solids, wellhead pressure, discharge line pressure and production decline, as well as the inflow behavior and solids production severity.

Fluid properties. Phase envelope, reservoir fluid type, bubbling pressure and dew point pressure are determined by sample analyses of produced hydrocarbon such as: chromatography, density, viscosity, among others. These properties allow establish the fluid flow behavior.

The produced solid samples characterization includes a compositional analysis and the determination of particle size distribution, roundness, sphericity and solubility. Compositional analysis is carried out by means of an X-ray spectrometry and diffraction test. The particle size distribution test considers washing and drying of samples as well as sieving (according to the API-RP-56 2000 standard). The roundness and sphericity are determined with a 3D particle analyzer. The solubility test is carried out with hydrochloric or hydrofluoric acid to different concentrations.

The device of the present invention is mainly based on:

Momentum conservation principle of the involved fluid streams (gas, oil, condensate and/or water); and In the energy transfer due to high velocity impact of a fluid (reservoir fluid) against another fluid in motion or static (accumulated liquids i.e. oil, condensate and/or water). The impact generates an atomized fluid mixture with an average velocity and pressure necessary to transport to surface.

The expansion, compression and mixing processes are considered in the calculations for the design of the device of the present invention. In each process there are specific methods that allow to calculate the flow area and to determine the geometry of each element. Once the device of the present invention was designed and manufactured, it must operate in optimum conditions for a period of time, in such a way that the investment be recovered and/or the hydrocarbon recovery factor in the long term, be increased.

The function of the device of the present invention is atomize the accumulated fluids at the bottomhole and incorporate them to the production casing, so facilitating their transport to surface. The accumulated fluids are incorporated to secondary flow conditioner (604) through the suction veins (603). During the atomization process, liquid drops moving inside the gas stream at critical speed are subjected to drag and gravitational forces, which fragment liquid drops.

Based on the above, the inflow behavior is determined, and the frictional pressure losses along petroleum production system are estimated by a nodal analysis, to determine if the well has enough energy to install the downhole device for hydrocarbon producing wells without conventional tubing (tubingless completion), which improves the hydrocarbon production (gas, oil and condensate), selectively controls produced solids (reservoir sand and hydraulic fracture proppant) and eliminates liquid loading.

The filtering element opening size with annular ovoid sintering is determined in order to retain from 95 to 100% of the produced solids, according to particle size distribution test. The differential pressure caused by the retained solids (natural sieve) around the filtering element with annular ovoid sintering should not exceed 20% of the inlet pressure. The differential pressure can be estimated in laboratory by measuring the inlet and outlet pressure of the system, as well as pressure behavior respect to forming the natural sieve. The operating conditions (pressure, temperature and flow rate) are defined according to the well conditions.

Once the feasibility of installation of the device of the present invention has been determined, its manufacture proceeds, with the adequate geometry and filtering element with annular ovoid sintering for installing the device in the well and later evaluating the benefits with the well behavior study.

EXAMPLE

A practical example is described below to better understand the application of the device of the present invention, without limiting the benefits that it may bring to the well:

Example 1

I. Data Collection and Analysis of the Well Operating Conditions.

Information of the T-212 gas and condensate producing well, was collected, which presents solids production and liquid loading problems to propose a specific solution.

Figure 8:
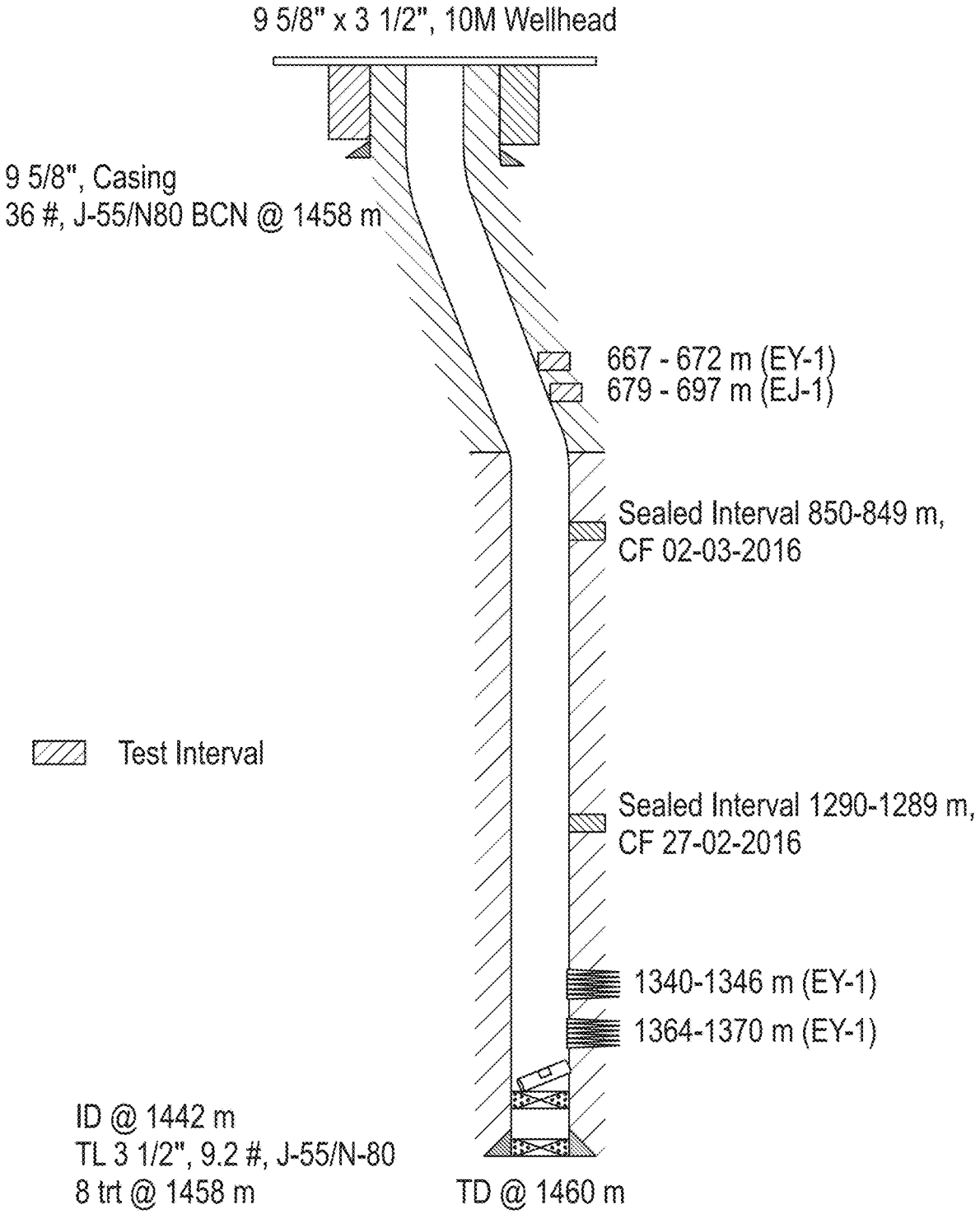
FIG. 8, shows T-212 well schematic.
Figure 9:
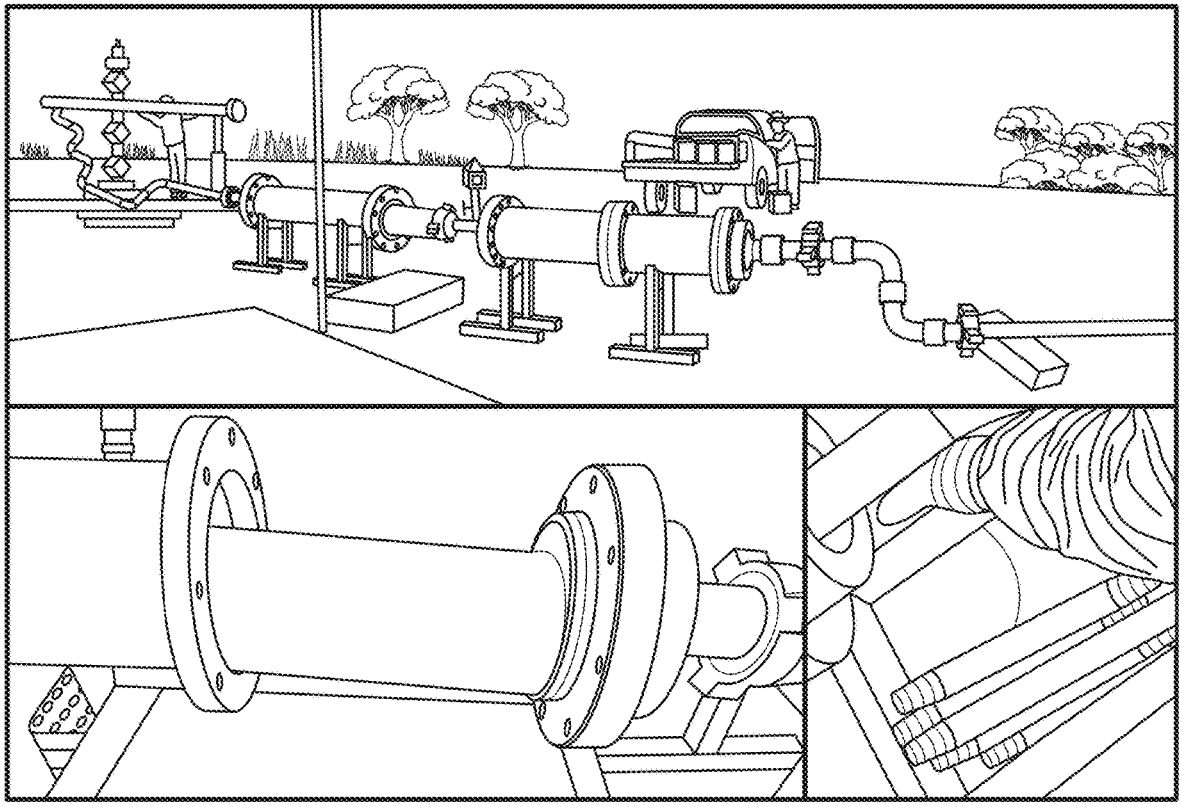
FIG. 9, shows solids retainer modular meter in surface as well as the sampling of solids in T-212 well.
Figure 10:
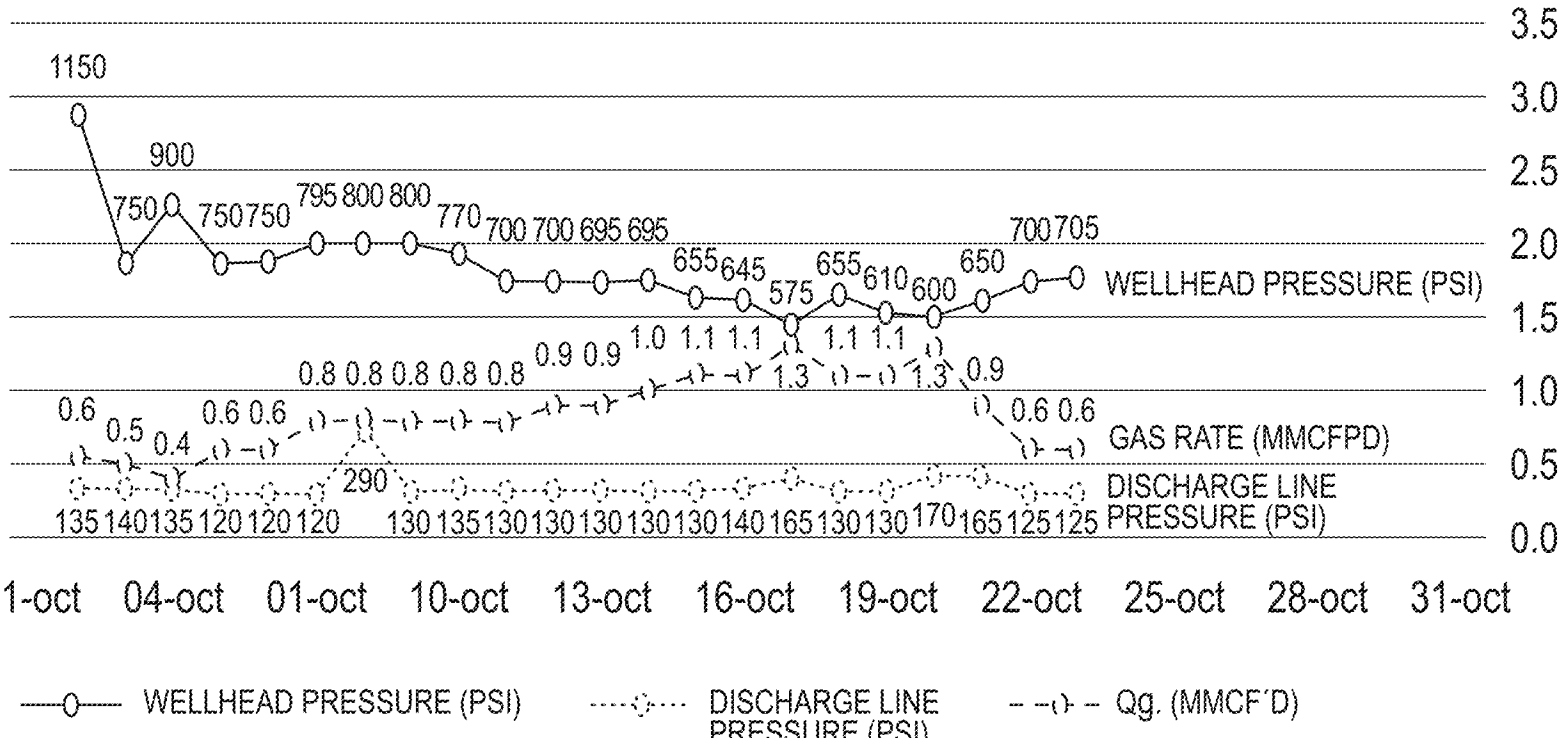
FIG. 10, shows T-212 well production data, wellhead pressure, discharge line pressure and gas rate as a function of time.
Figure 11:
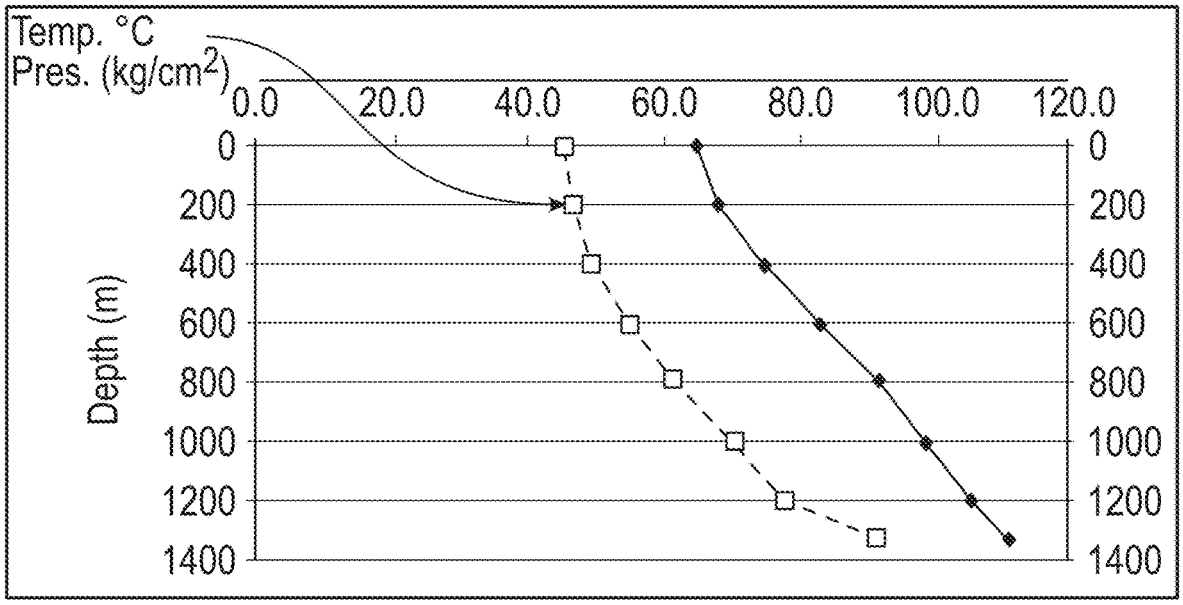
FIG. 11, shows the graph of pressure and temperature with respect to the depth of the T-212 well, obtained from flowing bottomhole pressure log, at the average depth of the perforations.

Collected information from T-212 well is as follows:

Well schematic (FIG. 8);

Samples of produced solids or information about their properties (FIG. 9);

Well production data (FIG. 10): wellhead pressure, discharge line pressure and gas rate with respect to time;

Flowing bottomhole pressure record, at the average perforations depth (Table 1 and FIG. 11);

Samples of produced fluids or information about their properties (gas chromatography, [Table 2]);

TABLE 1

Flowing bottomhole pressure record (FBPR), T-212 well.

| STATION | DEPTH | BOTTOMHOLE PRESSURE | | TEMPERATURE | GRADIENT | |
|---|---|---|---|---|---|---|
| # | (m) | psia | Kg/cm²/m | (° C.) | Kg/cm²/m | NOTES |
| 1 | | 924 | 64.98 | 38 | | z |
| 2 | 200 | 972 | 68.35 | 39 | 0.0169 | |
| 3 | 400 | 1071 | 75.32 | 41 | 0.0348 | |
| 4 | 600 | 1189 | 83.61 | 46 | 0.0415 | |
| 5 | 800 | 1302 | 91.56 | 51 | 0.0397 | |
| 6 | 1000 | 1410 | 99.16 | 59 | 0.0380 | |
| 7 | 1200 | 1506 | 105.91 | 65 | 0.0338 | |
| 8 | 1330 | 1576 | 110.83 | 77 | 0.0379 | |

TABLE 2

Gas chromatography, T-212 Well.
Chromatography
T-212 Well
Natural gas chromatography
Date May 1, 2010

| Compound | Formula | % |
|---|---|---|
| Methane | $CH_4$ | 90.24 |
| Ethane | $C_2H_6$ | 4.78 |
| Propane | $C_3H_8$ | 1.7 |
| Iso-Butane | $iC_4H_{12}$ | 0.51 |
| n-Butane | $C_4H_{10}$ | 0.44 |
| Iso-Pentane | $iC_5H_{12}$ | 0.25 |
| Pentane | $C_5H_{12}$ | 0.18 |
| Hexanes | $C_8H_{14}$ | 0.70 |
| Nitrogen | $N_2$ | 0.86 |
| Carbon Dioxide | $CO_2$ | 0.34 |
| Total | | 100 |
| Gas relative density | Air = 1 | 0.639 |
| Molecular weight | $lb_m/lb_{Mol}$ | 18.15 |

II. Selection of Candidate Well

T-212 hydrocarbon producing well was detected with solids production problems. Samples were taken with the installation of the solids retainer modular meter in surface, with screen modules of 700, 300 and 50 μm. The surface retainer was operating for 3 hours, and the solids recovered in each module were quantified, obtaining a total weight of 11.6 kg. The daily solids production was 109 kg.

The flow behavior analysis was performed with production data, gas chromatography and well schematic of T-212 well. It was determined that the well had liquid loading problems, affecting gas production. The well do not have conventional tubing, it is a well with tubingless completion.

It was determined that T-212 well was a candidate through complete data analysis, for the installation of the device of the present invention to solve two main problems: production of solids and liquid loading.

III. Sampling and Analysis of Produced Solids.

Figure 12:
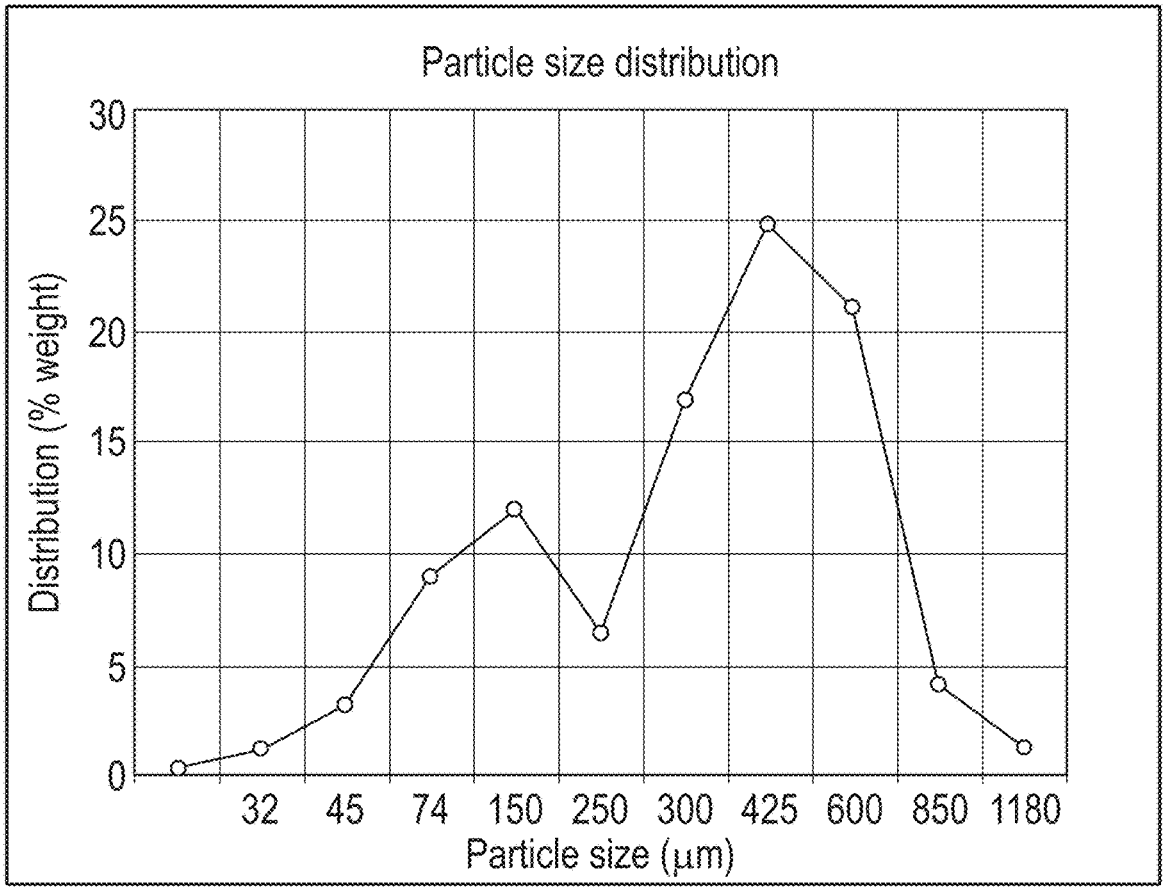
FIG. 12, shows the particle size distribution graph of produced solids sample by T-212 well.

The particle size distribution analysis was performed with T-212 well produced solid samples, according to ASTM D422 and API RP 56. The procedure of separating, washing, drying and quantification of solids is described as follows:

1) The solid-liquid separation was carried out by filtering method.
2) The sample was washed to remove all the hydrocarbon residues and the sample was dried in an oven at 110° C.
3) The sieve series was placed in descending order according to the opening size with the following sieve stack: 16, 20, 30, 40, 50, 60, 100, 200, 325 and 450 (1180-32 μm mesh).
4) Each sieve was separately weighed and its mass without solids was recorded.
5) The sieve stack was placed in Rotap® equipment and the sample was weighed and poured over the upper sieve.
6) The sieve lid was placed and the sieves were secured. Rotap® was operated at 290 rpm and 156 hits/min for 10 min.
7) The sieve stack was removed from the equipment and the content of each sieve was individually weighed.
8) Individual percentages of each sieve were calculated, according to the weight obtained previously and the size distribution was done (Table 3 and FIG. 12). And
9) Solid loss was calculated: all the individual weights were added and the total weight of the initial sample was subtracted, the percentage of loss was calculated (it shall not exceed of 0.2%).

TABLE 3

Particle size distribution, T-212 well.

| SIEVE | MICRONS | SCREEN WEIGTH WITHOUT SOLIDS (gr) | SCREEN WEIGTH WITH SOLIDS (gr) | WEIGHT OF SOLIDS (gr) | WEIGHT (%) |
|---|---|---|---|---|---|
| 16 | 1180 | 405.28 | 406.58 | 1.30 | 1.29 |
| 20 | 850 | 385.90 | 390.20 | 4.30 | 4.26 |
| 30 | 600 | 373.93 | 395.08 | 21.15 | 20.94 |
| 40 | 425 | 354.31 | 379.16 | 24.85 | 24.60 |
| 50 | 300 | 251.65 | 268.75 | 17.10 | 16.93 |
| 60 | 250 | 336.32 | 32.80 | 6.48 | 6.41 |
| 100 | 150 | 324.32 | 336.41 | 12.09 | 11.97 |
| 200 | 74 | 330.99 | 340.00 | 9.01 | 8.92 |
| 325 | 45 | 213.02 | 216.29 | 3.27 | 3.24 |
| 450 | 32 | 212.51 | 213.69 | 1.18 | 1.17 |
| PAN | — | 329.18 | 329.47 | 0.29 | 0.29 |
| | | | | 101.12 | 100.00 |

Figure 13:
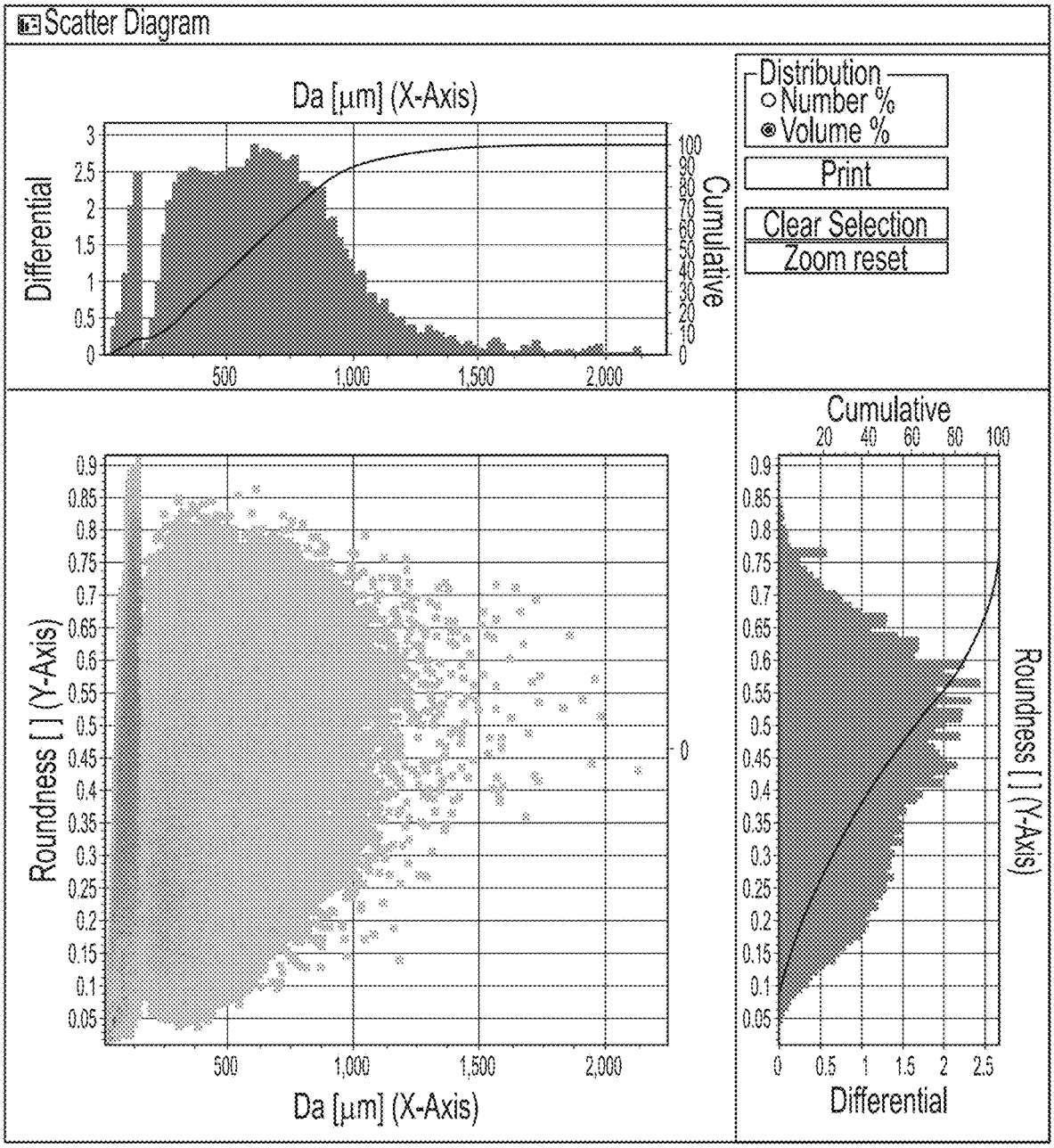
FIG. 13, shows the diagram of roundness versus particle diameter of produced solid sample by T-212 well, obtained with the 3D particle analyzer.
Figure 14:
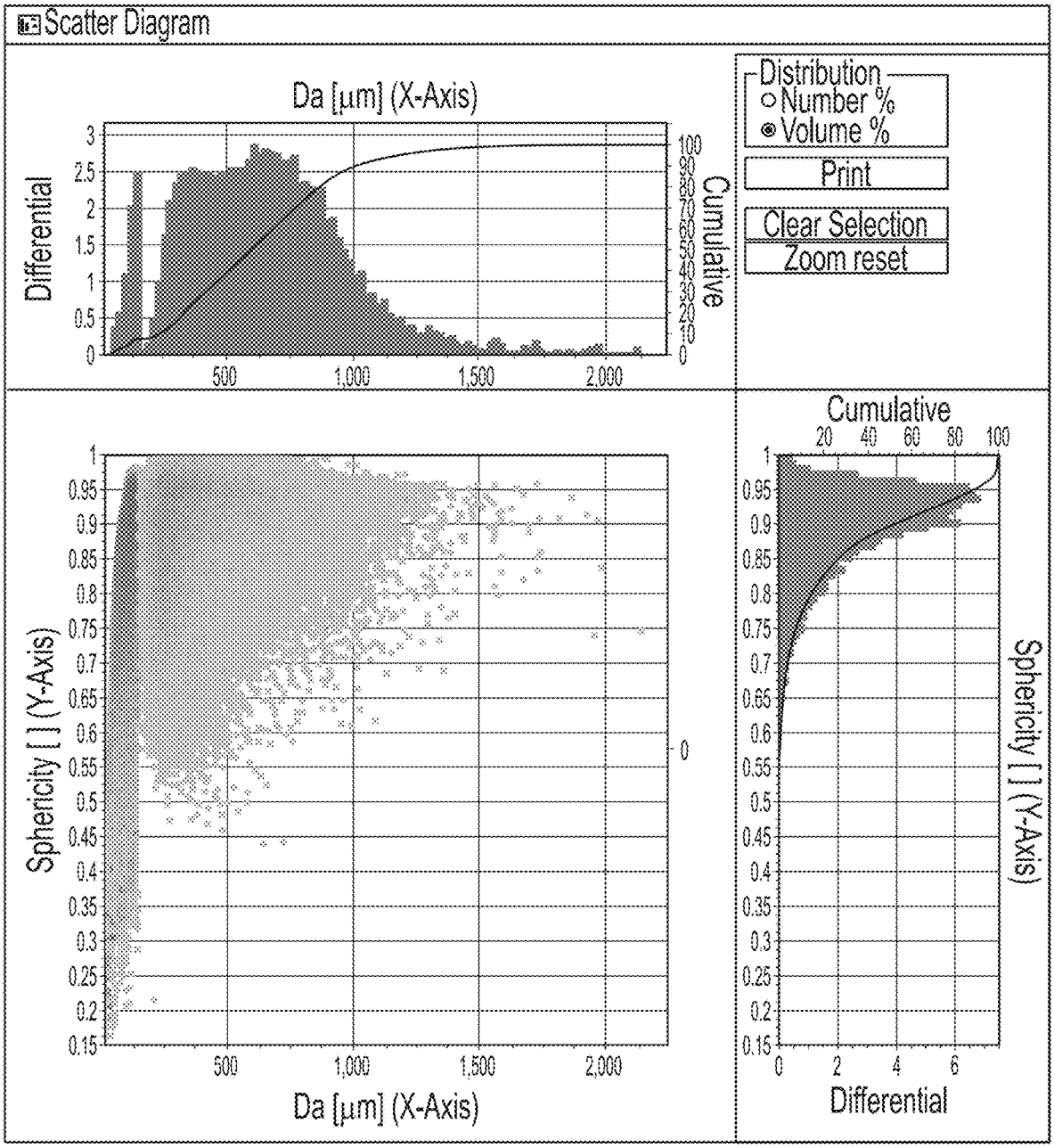
FIG. 14, shows the diagram of sphericity versus particle diameter, of produced solid sample by T-212 well, obtained with the 3D particle analyzer.
Figure 15:
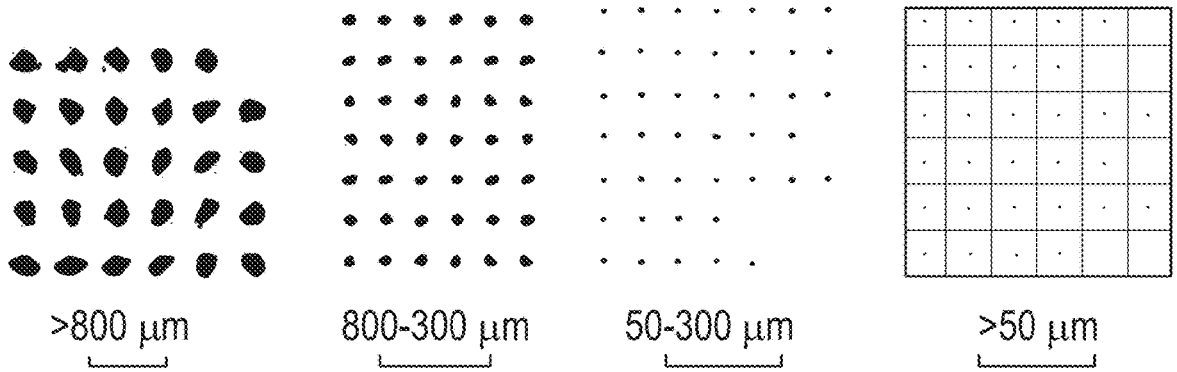
FIG. 15, shows the images of the particles in produced solid sample by T-212 well, obtained with the 3D particle analyzer.

The particle size distribution of the solids sample obtained from T-212 well was carried out in the 3D particle analyzer. The roundness and sphericity diagrams of the sample (FIGS. 13 and 14 respectively) were obtained. The images of roundness of the particles were taken by the 3D particle analyzer; FIG. 15 shows particles with a medium sphericity and low roundness.

Composition

Figure 16:
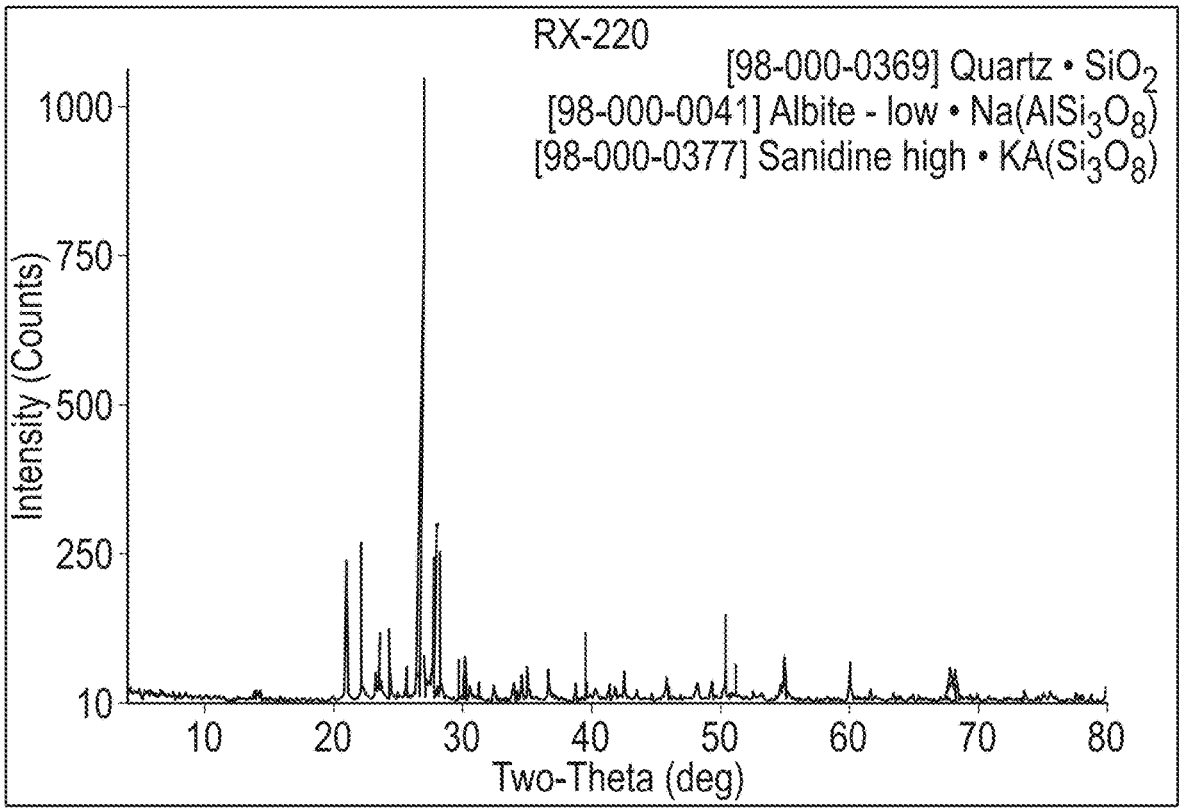
FIG. 16, shows the results of X-ray diffraction and spectrometry analysis of produced solid sample by T-212 well.

X-ray diffraction and spectrometry analyses of the produced solids sample from T-212 well were carried out to determine its composition (Table 4 and FIG. 16).

TABLE 4

Spectrometry and X-ray diffraction test results of T-212 well.
X-RAY FLUORESCENCE (SEMI-CUANTITATIVE), T-212 WELL.

| CHEMICAL ELEMENT | CONCENTRATION (% WEIGHT) |
|---|---|
| O | 47.30 |
| Si | 30.80 |
| Al | 9.40 |
| K | 4.03 |
| Na | 2.69 |
| Cl | 1.63 |
| Fe | 1.54 |
| Ca | 1.30 |
| Mg | 0.076 |
| Ti | 0.30 |
| Si | 0.12 |
| Mn | 0.04 |
| Sr | 0.04 |
| Mo | 0.03 |

Oil and water analyses of well T-212 were carried out (Table 5 and 6).

TABLE 5

S.A.R.A. Analysis.

| CUSTOMER IDENTIFICATION | | METHOD: 05LA-34080509-PP-MP-07 (VOLUMEN %) | | | |
|---|---|---|---|---|---|
| | | FREE WATER | EMULSIFIED WATER | SEDIMENTS | TOTAL WATER |
| T-212 | 13 Mar. 2018 | 78.00 | 0.00 | 0.00 | 78.00 |

The results of SARA analysis shows a stable crude without asphaltenes precipitation problems.

TABLE 6

| Stiff & Davis Analysis | | | | | |
|---|---|---|---|---|---|
| PHYSICAL PROPERTIES | | | | | |
| TEMPERATURE | 20.0° C. | | GAS IN SOLUTION | | (mg/L) |
| pH | 7.4 @ 19° C. | | | | |
| DENSITY | 1.0603 g/cm3 @ 20° C. | | HYDROGEN SULFIDE ($H_2S$) | | — |
| CONDUCTIVITY | 116856.85 μS/cm @ 20° C. | | CARBON DIOXIDE ($CO_2$) | | — |
| TURBIDITY | 6 FTU | | DISSOLVED OXYGEN ($O_2$) | | — |
| COLOR | 34 Pt—Co. | | | | |
| ODOR | | | | | |
| CHEMICAL PROPERTIES | | | | | |
| CATIONS: | (mg/L) | (meq/L) | ANIONS: | (mg/L) | (meq/L) |
| SODIUM ($Na^+$) | 26178.88 | 1138.757 | CHLORIDES ($Cl^-$) | 53800.00 | 1517.502 |
| POTASSIUM ($K^+$) | — | — | SULPHATES ($SO4^=$) | 20.00 | 0.416 |
| CALCIUM ($Ca^{++}$) | 5000.00 | 249.501 | CARBONATES ($CO_3^=$) | 7.20 | 0.240 |
| MAGNESIUM ($Mg^{++}$) | 1495.07 | 122.990 | BICARBONATES ($HCO_3^-$) | 54.66 | 0.896 |
| IRON ($Fe^{++}$) | 0.18 | 0.006 | HYDROXIDES ($OH^-$) | — | — |
| MANGANESE ($Mn^{++}$) | — | — | NITRITES ($NO_2^-$) | — | — |
| BARIUM ($Ba^{++}$) | 195.00 | 7.800 | NITRATES ($NO_3^-$) | — | — |
| STRONTIUM ($Sr^{++}$) | — | — | PHOSPHATES ($PO_4^{-3}$) | — | — |
| TOTAL: | 32869.13 | 1519.054 | TOTAL: | 53881.86 | 1519.054 |
| DISSOLVED AND SUSPENDED SOLIDS | | | | | |
| | (mg/L) | | | | (mg/L) |
| TOTAL SOLIDS | — | | TOTAL HARDNESS as $CaCO_3$ | | 18650.00 |
| TOTAL SISSOLVED SOLIDS (TDS) | 86750.98 | | CALCIUM HARDNESS as $CaCO_3$ | | 12500.00 |
| TOTAL SUSPENDED SOLIDS (TSS) | — | | MAGNESIUM HARDNESS as $CaCO_3$ | | 6150.00 |
| GREASE AND OILS | — | | ALKALINITY TO THE "F" as $CaCO_3$ | | 0.00 |
| SOLUBLE SILICA ($SiO_2$) | — | | ALKALINITY TO THE "M" as $CaCO_3$ | | 56.80 |
| FERRIC OXIDE ($Fe_2O_3$) | — | | SALINITY as NaCl | | 88685.85 |
| ACIDITY as CaCO3 | — | | STABILITY INDEX | | −0.00300 |
| | | | TENDENCY | | CORROSIVE |
| BACTERIOLOGICAL PROPERTIES | | | | | |
| | (Colony/mL) | | | | (Colony/mL) |
| AEROBIC MESOPHILIC BACTERIA | — | | SULFATE-REDUCING BACTERIA | | — |

Stiff & Davis water analysis reflects a corrosive environment with little likelihood of inorganic scales, however, in case of scale, it would be by calcium carbonate.

IV. Simulation of Production Conditions.

The nodal analysis was executed with IMP Flow software. For static bottomhole pressure a value of 2.100 psi was considered; the flowing bottomhole pressure was 1.576 psi, it was obtained from flowing bottomhole pressure records. Production data used include:

Gas rate ($Q_g$)=0.4 mmpcd,

Water rate ($Q_w$)=64 bpd, and

Wellhead pressure ($P_{wh}$)=924 psi,

10/64" surface choke.

Figure 18:
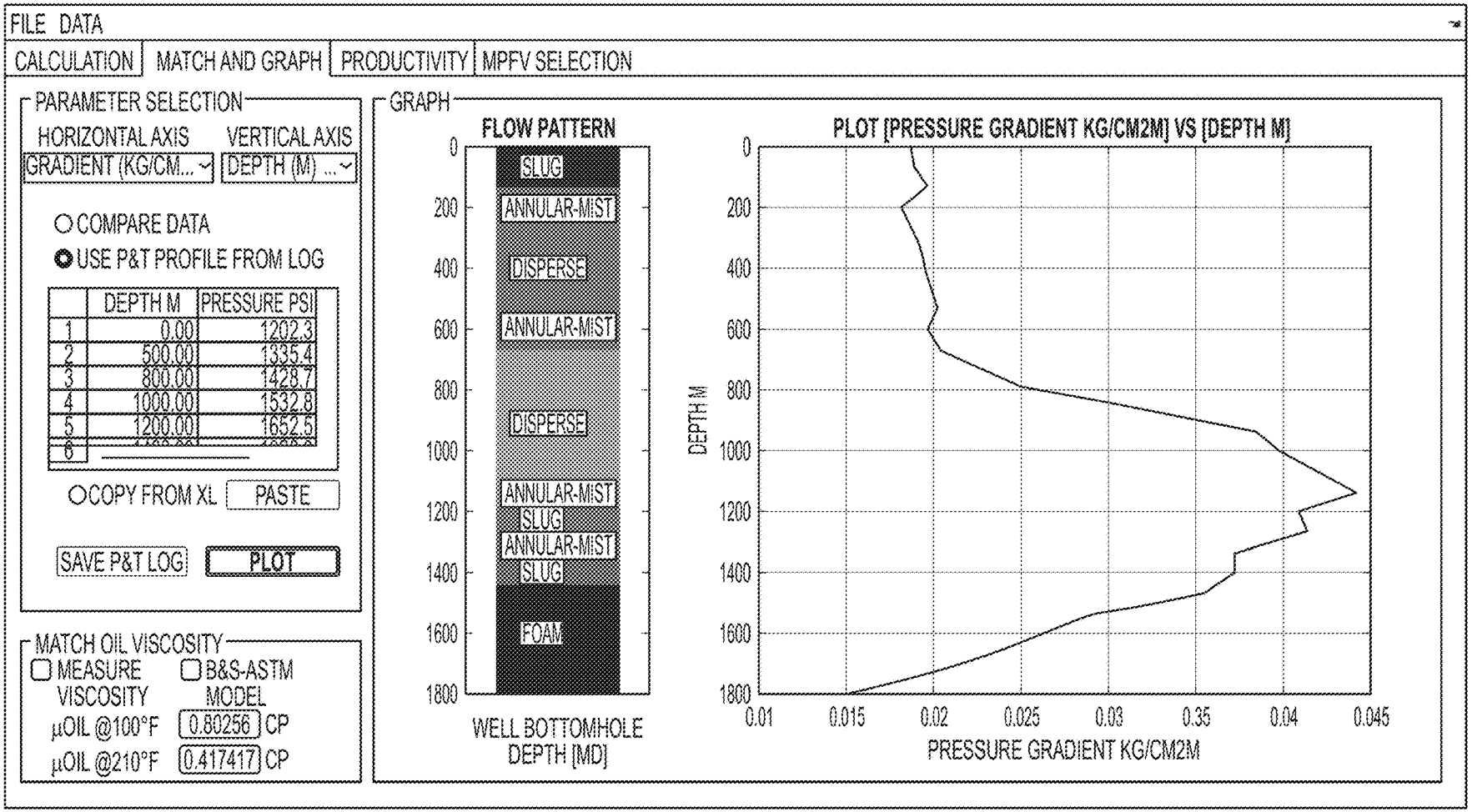
FIG. 18, shows the screen obtained from the IMP Flow simulator, with the calculation of pressure gradient in the tubing, respect to the behavior of the flow pattern of the T-212 well, with a 10/64 in. surface choke.

In order to reproduce actual production conditions, data were captured on IMP Flow software (FIG. 17). FIG. 18 shows both actual production conditions with 10/64" surface choke and the calculations of pressure gradient inside production casing with respect to the flow pattern behavior.

Figure 19:
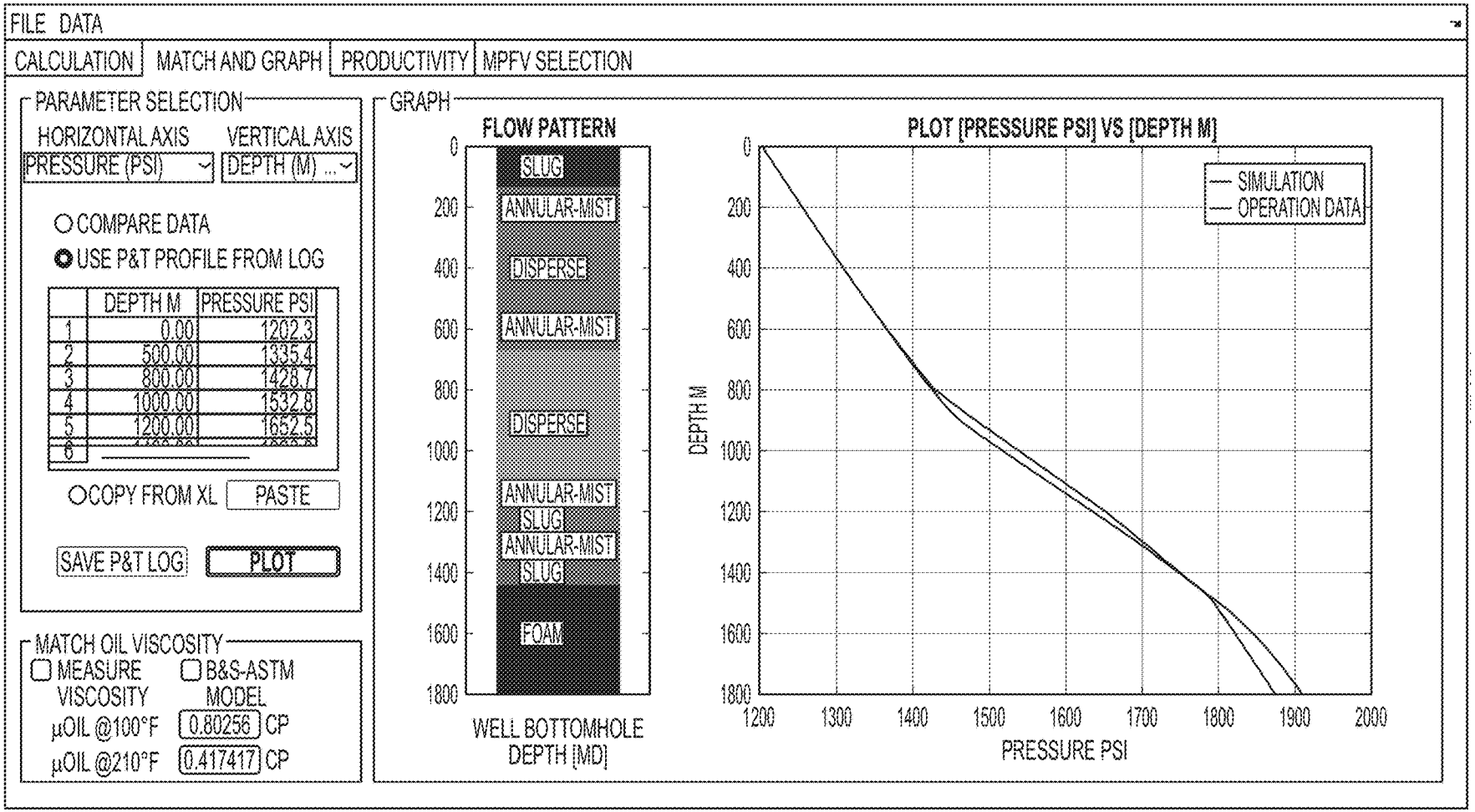
FIG. 19, shows the screen obtained from the IMP Flow simulator, with the simulation of match of T-212 well flowing bottomhole pressure, respect to the behavior of the flow pattern.
Figure 20:
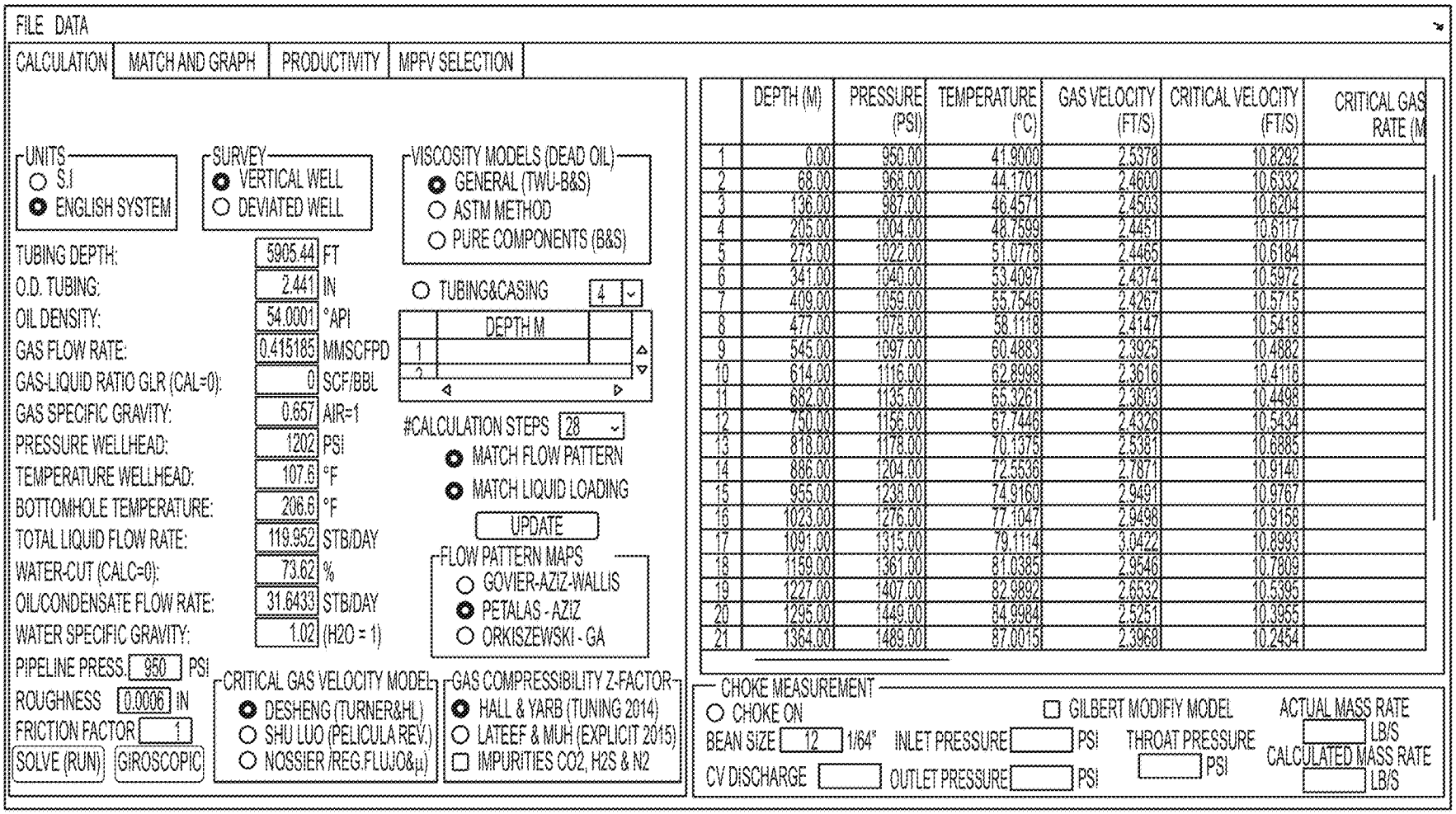
FIGS. 20 and 21, show the screens with the results of the T-212 well simulation, with a diameter of the device of the present invention of 10/64 in. placed inside the well at depth of 1,230 and and with a choke of 14/64 in. at the surface.
Figure 21:
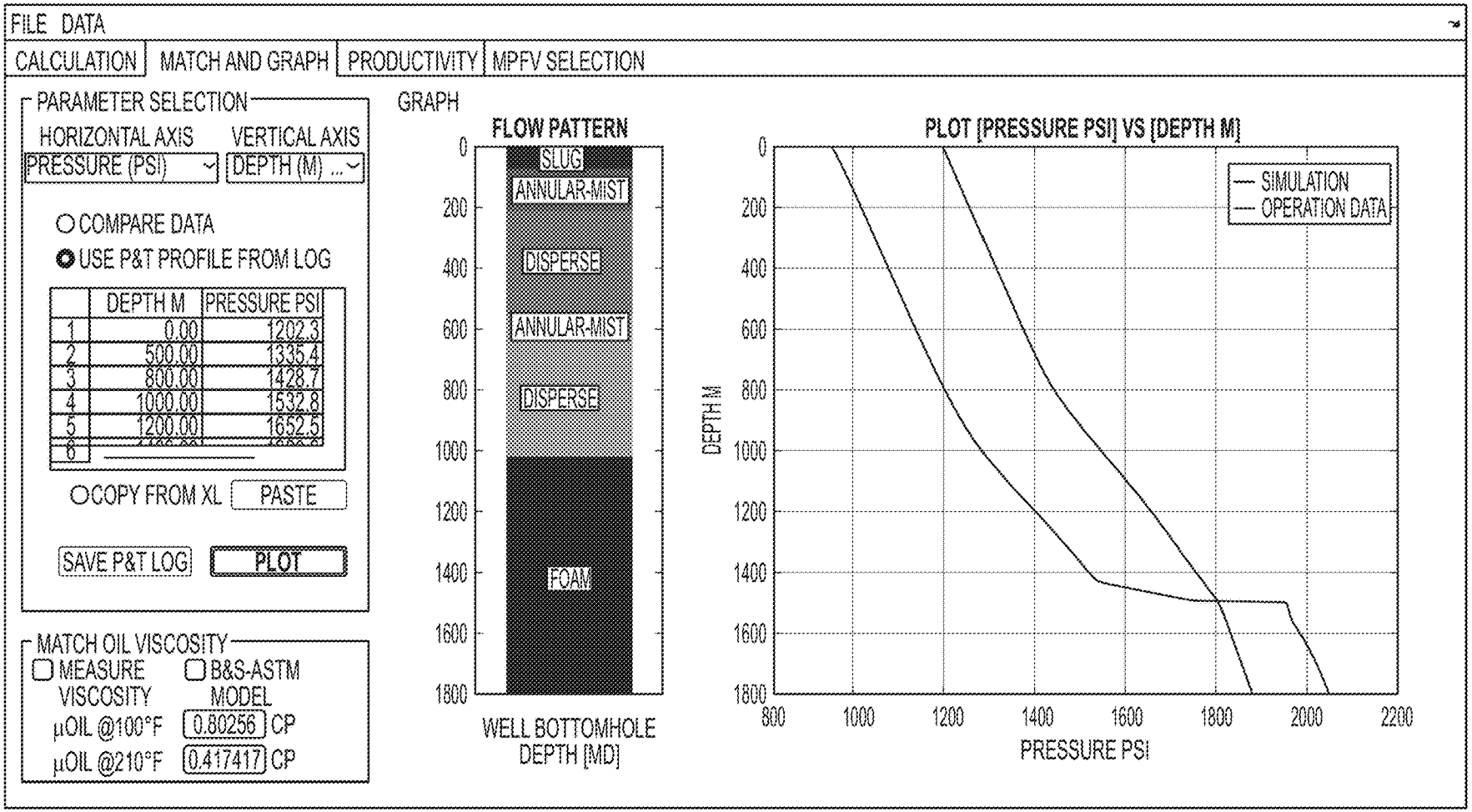

FIG. 19 shows flowing bottomhole pressure fit for T-212 well obtained with simulation, with respect to the flow pattern behavior. FIGS. 20 and 21 show T-212 well simulation results with a 10/64" device of the present invention, set at a depth of 1.230 md, and a 14/64" surface choke.

V. Design and Manufacture

Based upon particle size distribution analysis results, use of 100 μm filtering element with annular ovoid sintering was determined, to retain 90% of produced solids. A 10/64" secondary conditioner diameter was determined to obtain an approximately 65% energy savings.

VI. Installation

Based upon used methodology, it was determined, as technical feasible, to install the downhole device for hydrocarbon producing wells without conventional tubing (tubingless completion), of the present invention, with solids presence.

Calculations were carried out on IMP Flow software; a 2.100 psi static bottomhole pressure value and a 1.576 psi flowing bottomhole pressure value were considered for nodal analysis. Production data were: $Q_g$=0.6 mmpcd, $Q_w$=64 bpd, $P_{wh}$=924 psi, with a 14/64" surface choke.

Pressure loss through production casing was reduced from 570 to 200 psi, installing the downhole device of the present invention, with a 10/64" secondary flow conditioner, which leads an approximately 65% energy savings.

Pressure drop caused by natural sieve was compensated with the installation of the device of the present invention, trough pressure requirements reduction to transport the fluids from bottomhole to surface.

Results are shown in Table 7.

TABLE 7

T-212 well results.

| OPERATIONAL PARAMETERS | DESCRIPTION | VALUES BEFORE INSTALLING | VALUES AFTER INSTALLING | INCREASE (%) |
|---|---|---|---|---|
| Qc (bpd) | Oil flow rate, barrels per day | 18.0 | 23.0 | 27.8 |
| Qg (mmpcd) | Gas flow rate, millions of standard cubic feet per day | 0.6 | 0.8 | 33.3 |
| Qw (bdp) | Water flow rate, barrels per day | 64.0 | 16.0 | −75.0 |
| Ql (bdp) | Liquid net flow rate, barrels per day | 82.0 | 39.0 | −52.4 |
| Ple (kg/cm2) | Discharge line pressure, kilograms per square centimeter | 125.0 | 133.0 | 6.4 |
| ΦE (64th) | Choke/secondary conditioner diameter | 14.0 | 10.0 | −28.6 |
| RGA (m3/m3) | Gas-Oil Ratio | 5.932.9 | 6.190.9 | 4.3 |
| Water (%) | Water percentage | 78.0 | 41.0 | −47.4 |

Using the device of the present invention, a selective produced solids control is achieved and liquid loading problem is eliminated, protecting the mechanical integrity of the elements composing the petroleum production system. The above contributes to:

Solids production reduction in 95%.

Oil production increase of 27.8%.

Gas production increase of 33%.

Water production reduction of 75%, and

Water percentage reduction of 47.4%.

The device of the present invention reduces 65% of pressure requirements to fluid transport from bottomhole to surface, optimizes the flow pattern and avoids solids accumulation in petroleum production system, which corroborates the functionality of the device of the present invention.

What is claimed is:

1. A downhole device for hydrocarbon producing wells without conventional tubing (tubingless completion), wherein the device comprises:

(a) a first section (200) comprising a filtering element with annular ovoid sintering (202) and a protective housing (201);

(b) a second section (300), connected to an upper end of the first section (200) and comprising a primary flow conditioner, in which the hydrocarbon flow (704) enters to a progressively decreasing cross section (303) until reaching a circular flow area (304) which extends as a cylindrical portion to transport the flow from bottomhole to surface;

(c) a third section (400) connected to an upper end of the second section (300) by an external sleeve (401) comprising a homogenization and stabilization chamber (407) which has external sleeves (401, 403 and 404), wherein the chamber is connected with a support (405) that seals (406) against the external sleeve (401), wherein the homogenization and stabilization chamber (407) has a flow area and length that is connected at upper end (408) with a secondary flow conditioner, and outside supports of an anchoring and sealing system and the external sleeves (401, 403 and 404) of the homogenization and stabilization chamber (407);

(d) a fourth section (500) comprising the anchoring and sealing system consisting of a tubular cylindrical portion (502) which has an outside provided with a set of anchors (501) fixed to a part of an interior well pipe, wherein the anchors are spaced from each other in a radial direction and provided with a clamp or parallel set of stepped rows to partially penetrate the interior of the well pipe; wherein the anchoring and sealing system is also provided with a series of flexible coaxial annular joints (507) spaced longitudinally to each other with spacer rings (504) and anchors (501) placed on an external face, internally supported by a cylindrical portion (502), and externally supported by protective sleeves (503, 505 and 506); and (e) a fifth section (600) comprising the secondary flow conditioner, which has a central passage opening (607) with a cross section that decreases at a constant acute angle with respect to an axis of symmetry until reaching a circular flow area which extends as a cylindrical portion (606) which has diagonally oriented openings called suction veins (603), which point towards the bottomhole to create a passage to a higher velocity zone, and, wherein the secondary flow conditioner is connected to a support (601) with the homogenization and stabilization chamber (407) by means of a connection (408) in the upper end, that allows the flow to exit in accelerated form through the central passage opening (607).

2. The device of claim 1, wherein the filtering element is defined by an annular ovoid sintering (202).

3. The device of claim 1, wherein the protective housing (201) forms a porous and permeable media from a perforated interval (702) to outside of the filtering element with annular ovoid sintering (202).

4. The device of claim 1, wherein the anchoring and sealing system allows installation of the device at any depth, in production casing, in tubingless completion.

5. The device of claim 1, wherein the suction veins (603) are inside of the secondary flow conditioner (604) and connect interior low pressure zones of the secondary flow conditioner (604) with external accumulated liquid.

* * * * *